United States Patent [19]

Carpenter

[11] 4,345,979

[45] Aug. 24, 1982

[54] METHOD AND APPARATUS FOR RECOVERING GEOPRESSURED METHANE GAS FROM OCEAN DEPTHS

[76] Inventor: Neil L. Carpenter, 175 Nimitz Rd., Kerrville, Tex. 78208

[21] Appl. No.: 142,101

[22] Filed: Apr. 21, 1980

Related U.S. Application Data

[60] Division of Ser. No. 807,739, Jun. 17, 1977, Pat. No. 4,199,025, which is a continuation-in-part of Ser. No. 624,391, Oct. 21, 1975, Pat. No. 4,037,655, which is a continuation of Ser. No. 462,326, Apr. 19, 1974, abandoned, which is a continuation-in-part of Ser. No. 228,846, Feb. 24, 1972, abandoned.

[51] Int. Cl.[3] ..... C25B 1/00; C25B 9/04

[52] U.S. Cl. ..... 204/101; 204/98; 204/128; 204/130; 204/194; 204/228

[58] Field of Search ..... 204/98, 128, 129, 130, 204/228, 194, 95, 101; 166/248

[56] References Cited

U.S. PATENT DOCUMENTS

| | | | |
|---|---|---|---|
| 636,321 | 11/1899 | Craney | 204/108 |
| 2,761,829 | 9/1956 | Dolloff | 204/106 |
| 2,806,818 | 9/1957 | Howard | 204/130 |
| 3,819,231 | 6/1974 | Fehlner | 204/106 |
| 3,957,601 | 5/1976 | Drinkard et al. | 204/105 R |

*Primary Examiner*—R. L. Andrews

*Attorney, Agent, or Firm*—Darryl M. Springs

[57] ABSTRACT

Method and apparatus are disclosed for recovering geopressured methane gas dissolved in ocean depths including at least a pair of spaced-apart electrodes lowered into electrical contact with the geopressured methane dissolved in the ocean salt water at a selected depth. The salt water carrying the dissolved methane gas acts as an electrolyte. The electrodes are insulated from substantially all overlying ocean above the selected depth to establish an electrical circuit composed of the spaced-apart electrodes and the salt water electrolyte at the selected depth containing the methane gas. An AC electrical current flow is then established through the electrodes and the salt water electrolyte for establishing an AC electrical field surrounding the electrodes and releasing molecules of free methane gas which rises vertically to the ocean surface. Means are provided at the ocean surface for trapping and recovering the free methane gas.

9 Claims, 22 Drawing Figures

METHOD AND APPARATUS FOR RECOVERING GEOPRESSURED METHANE GAS FROM OCEAN DEPTHS

CROSS REFERENCE TO RELATED APPLICATION

This is a division of application Ser. No. 807,739, filed June 17, 1977. Now U.S. Pat. No. 4,199,025 which is a continuation-in-part of co-pending U.S. patent application Ser. No. 624,391, filed Oct. 21, 1975, now U.S. Pat. No. 4,033,655 which was a continuation of co-pending U.S. patent application Ser. No. 462,326, filed Apr. 19, 1974, now abandoned which was a continuation-in-part of co-pending U.S. patent application Ser. No. 228,846, filed Feb. 24, 1972 now abandoned.

BACKGROUND OF THE INVENTION

This invention relates to methods and apparatus for establishing an AC electrical field in a subsurface fossilized mineral fuel, and establishing in response to the electrical field a zone of electrochemical activity resulting in electrochemical reactions with the hydrocarbon constituent elements of the earth formation for increasing the formation pressure, reducing the viscosity of any hydrocarbon fluids in the formation, and aiding in the production of subsurface hydrocarbon bearing materials from the earth formation over an area greatly exceeding the zone of electrochemical activity.

As used herein, "fossilized mineral fuels" includes oil, bitumens, (such as asphaltic tars), kerogens (such as oil shales) and coal, or any other fossil fuels having a hydrocarbon content. While the preferred embodiments will be described with respect to recovery of oil, the processes are applicable to recovery of all other fossilized fuels.

Until fairly recent times, it was relatively easy to find new oil reserves when a field was depleted or became unprofitable. In may fields only 15%-25% of the oil in place was actually recovered before reservoir pressure or drive was depleted or other factors made it uneconomical to continue to produce the field. As long as new reserves were readily available, old fields were abandoned. However, with the energy crisis now confronting the domestic oil industry, coupled with the fact that most of the existing on-shore oil in the United States has already been discovered, it is obvious that such known reserves must be efficiently and economically produced.

It has been estimated that at least 50% of the known oil reserves of the United States cannot be recovered using conventional or secondary methods. A substantial amount of this oil is of an abnormally low gravity, and/or high viscosity, often coupled with the fact that there is little or no pressure in the oil-bearing formation. In the absence of formation pressure, even oil of average viscosity and gravity is difficult to produce without adding external energy to the formation to move the oil into a producing borehole.

Accordingly, a great deal of attention has recently been given to various methods of secondary and tertiary recovery. Water flooding has been utilized, with mixed results, to attempt to increase the natural reservoir pressure hydraulically. Thermal flooding techniques, such as fire flooding, steam injection and hot water flooding have been utilized to alter the viscosity of the oil and enhance its flow characteristics. However, none of these thermal techniques contributes to increasing the formation pressure, and they have been successful only in a limited number of applications. All of the methods mentioned above require extensive, and often quite expensive surface installations for their utilization.

The prior art contains patents that have introduced electrical currents into a subsurface oil- or mineral-bearing formation for the express purpose of heating the formation in order to lower the viscosity and stimulate the flow of the oil or mineral in the immediate area involved in the heating process. Examples of such patents are: U.S. Pat. No. 849,524 (Baker, 1907); U.S. Pat. No. 2,799,641 (Bell, 1957); U.S. Pat. No. 2,801,090 (Hoyer, 1957); U.S. Pat. No. 3,428,125 (Parker, 1969); U.S. Pat. No. 3,507,330 (Gill, 1970); U.S. Pat. No. 3,547,193 (Gill, 1970); U.S. Pat. No. 3,605,888 (Crowson, 1971); U.S. Pat. No. 3,620,300 (Crowson, 1971), and U.S Pat. No. 3,642,066 (Gill, 1972). All of the above patents depend in some form on electrothermic action to enhance the flow characteristics of the oil or an "electro-osmosis" action whereby the oil tends to flow from an electrically charged positive region to a negatively charged region. However, none of the above patents suggests the establishment of a zone of AC electrochemical activity wherein an electrochemical reaction is promoted with constituent elements of the formation, such as salt water and oil, for increasing the internal pressure of the formation, altering the viscosity of the oil, and stimulating oil production over an area greatly exceeding the zone of electrochemical activity.

Accordingly, one primary feature of the present invention is to provide method and apparatus for establishing a zone of AC electrochemical activity in a subsurface formation resulting in electrochemical reactions with constituent elements of the formation, such as salt water and oil, for generating volumes of free gas in the formation functionally related to current density of the AC current in the formation for increasing the formation pressure.

Another feature of the present invention is to provide method and apparatus for establishing a zone of electrochemical activity in a subsurface formation for enhancing the flow characteristics of oil in the formation by lowering the viscosity and specific gravity of the oil.

Yet another feature of the present invention is to provide method and apparatus for establishing a zone of AC electrochemical activity in a subsurface formation for releasing salt water and oil in situ from the formation matrix within the zone of electrochemical activity and separating the oil and salt water within the earth formation matrix by gravitational action.

Still another feature of the present invention is to provide method and apparatus for establishing an AC electrical field within the subsurface formation employing a plurality of electrodes, each of the electrodes projecting into the formation through one of a plurality of spaced, electrically-insulated boreholes for insulating each of the electrodes from the earth structure surrounding the boreholes for preventing an electrical current path between the electrode and the earth structure, thereby isolating the electrical current path between the electrode and the subsurface formation.

SUMMARY OF THE INVENTION

The present invention may be utilized to aid in the recovery of any fossilized mineral fuel from a subsurface formation. However, without limiting the scope of this invention, and for purposes of illustration, the details of the present invention will be disclosed in context of recovering subsurface oil deposits. The problems of the prior art are remedied by providing methods of increasing formation pressure, altering the flow characteristics of the oil, and tertiary oil recovery from a subsurface earth formation comprising establishing AC electrical current flow within the subsurface formation through a plurality of spaced electrodes extending into the formation for establishing a zone of electrochemical activity in the formation resulting in electrochemical reactions with constituent elements of the earth formation, such as salt water and the oil, for generating volumes of free gases that increase the internal pressure of the earth formation. The electrochemical activity enhances the flow characteristics of the oil by lowering the viscosity of the oil through the solution of gases in the oil. The increased pressures of the formation act to drive oil into a producing borehole spaced from the zone of electrochemical activity. The electrochemical activity also releases the water and oil from the earth formation matrix within the zone of electrochemical activity and separates the oil and water within the earth formation matrix by gravitational action. Carbon dioxide or compressed air may be injected at selected locations within the oil bearing formation to further increase the formation pressure and enhance the flow of oil in the formation.

The apparatus for accomplishing the above described method is, in one preferred embodiment, comprised of a plurality of spaced boreholes drilled into the earth formation, a plurality of electrodes, one each of which is disposed in each of the boreholes extending from the surface of the earth into the subsurface earth formation, a source of AC electrical current connected to each of the electrodes for establishing an electrical current path within the subsurface earth formation, and a producing borehole drilled into the earth formation and spaced from the electrode boreholes for removing oil from the earth formation. In another preferred embodiment, the insulating means may be electrically insulating casing set into each of the boreholes between the surface of the earth and the top of the subsurface earth formation. Other means may be added to an electrode well for cooling the casing of the well from the heat generated by the passage of electrical current in the formation.

BRIEF DESCRIPTION OF THE DRAWINGS

In order that the manner in which the above-recited advantages and features of the invention are attained can be understood in detail, a more particular description of the invention may be had by reference to specific embodiments thereof which are illustrated in the appended drawings, which drawings form a part of this specification. It is to be noted, however, that the appended drawings illustrate only typical embodiments of the invention and therefore are not to be considered limiting of its scope, for the invention may admit to further equally effective embodiments.

IN THE DRAWINGS

Figure 1:
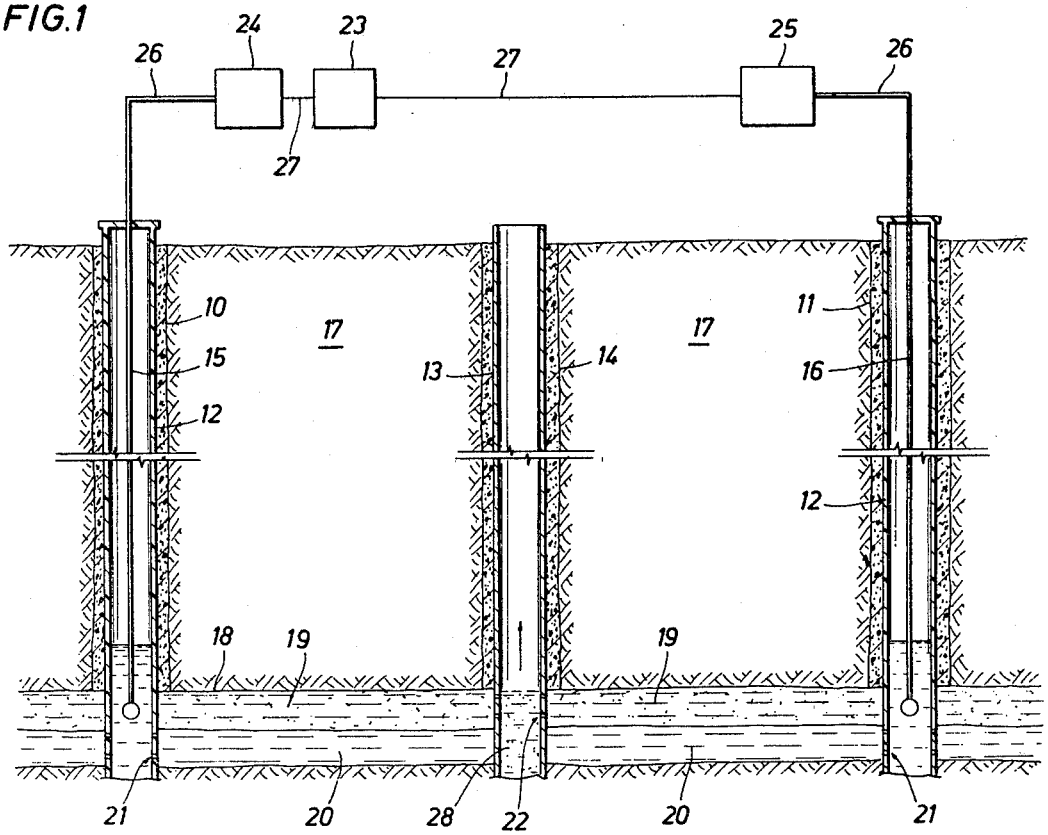
Figure 18:
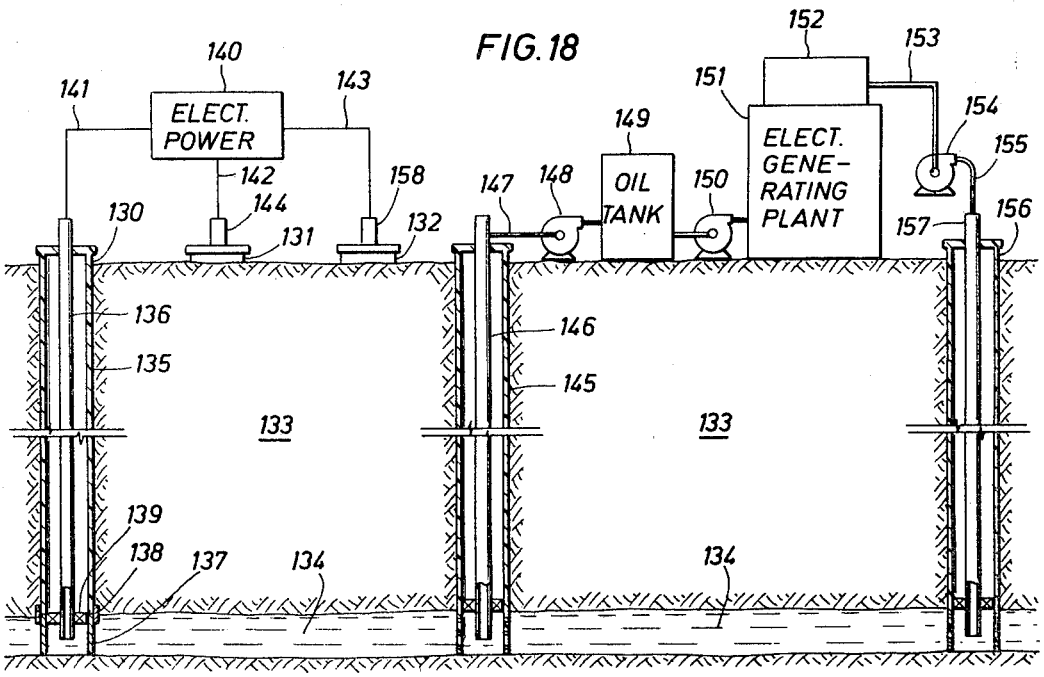
Figure 2:
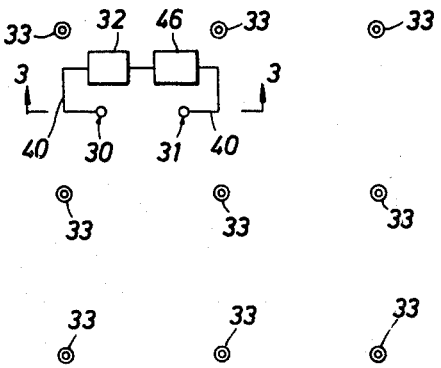
Figure 5:
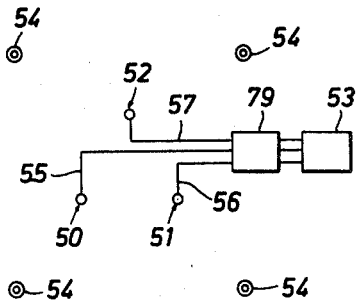
Figure 3:
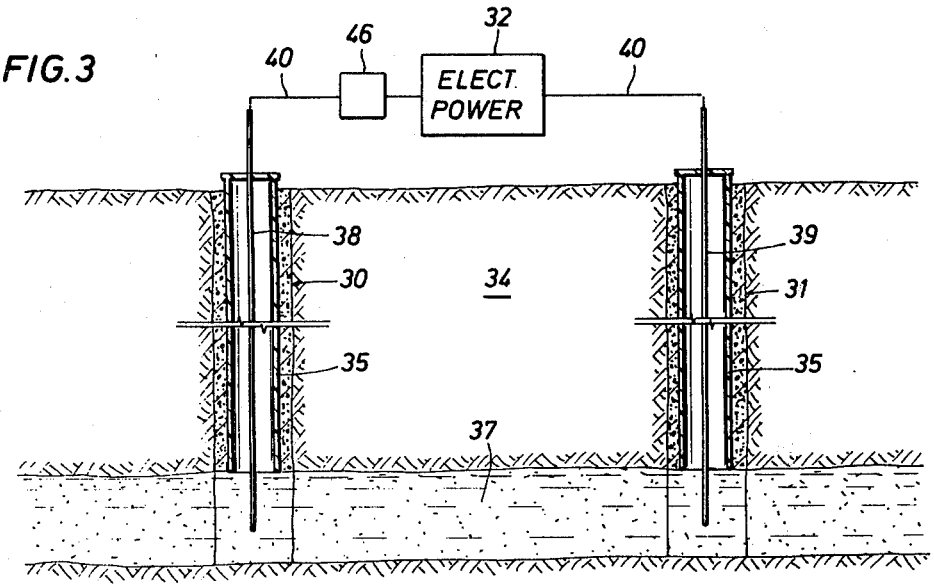
Figure 4:
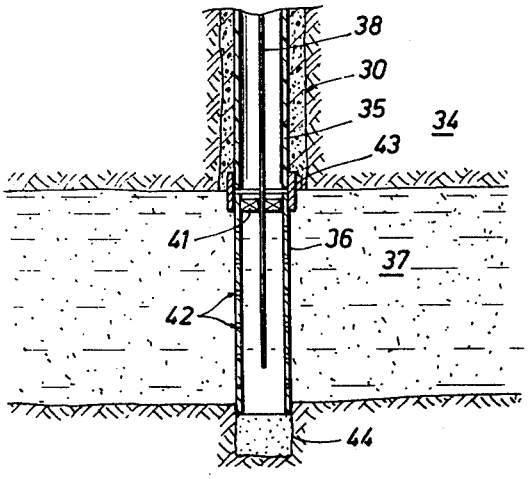
Figure 6:
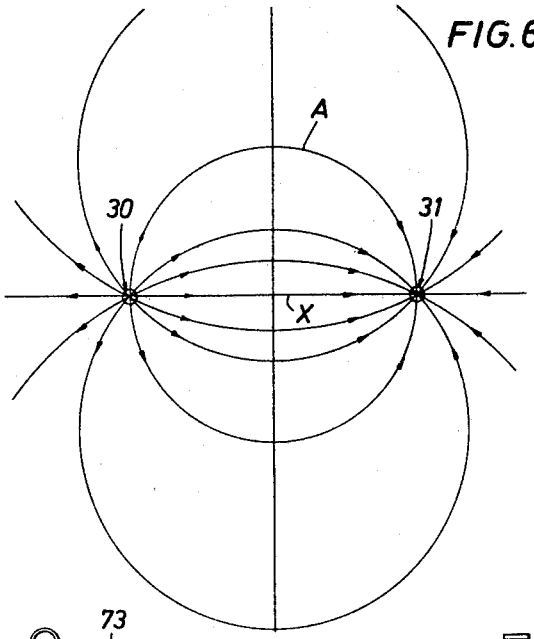
Figure 7:
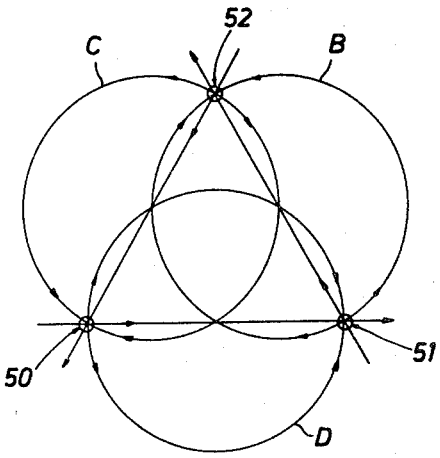
Figure 11:
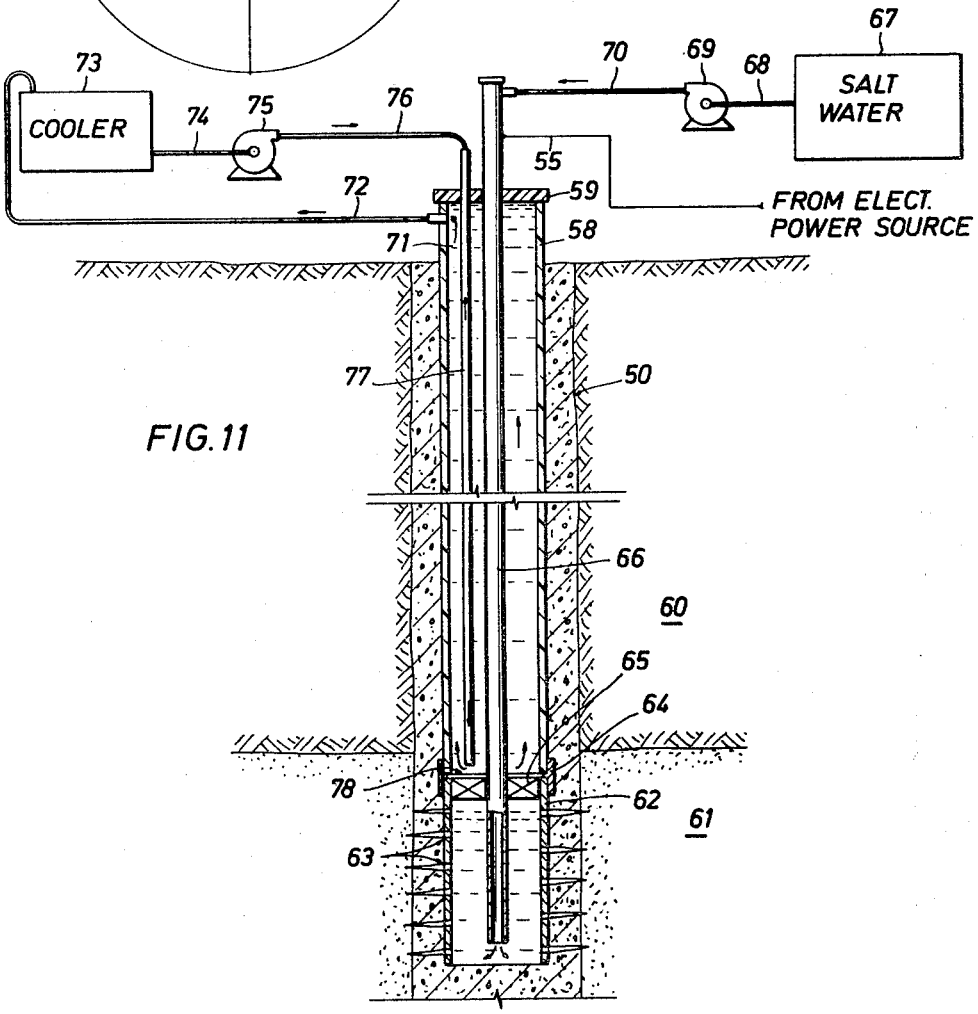
Figure 8:
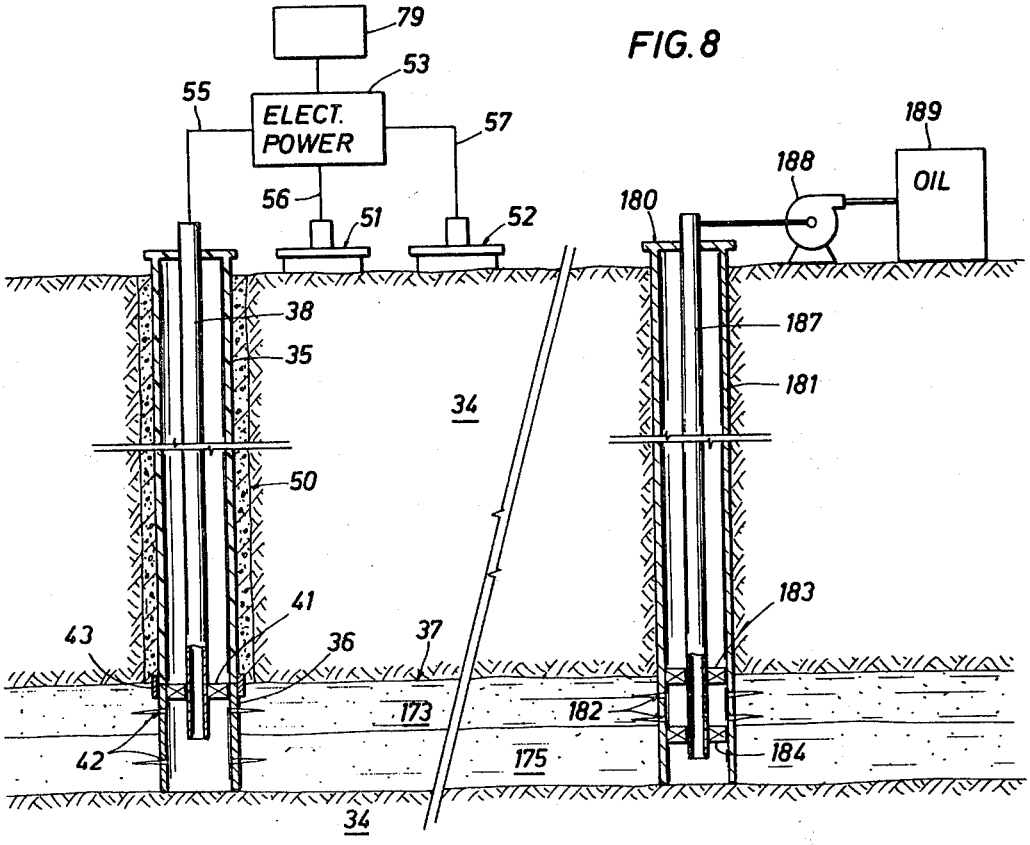
Figure 9:
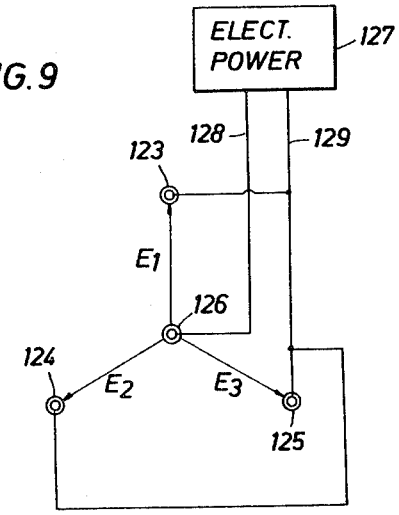
Figure 10:
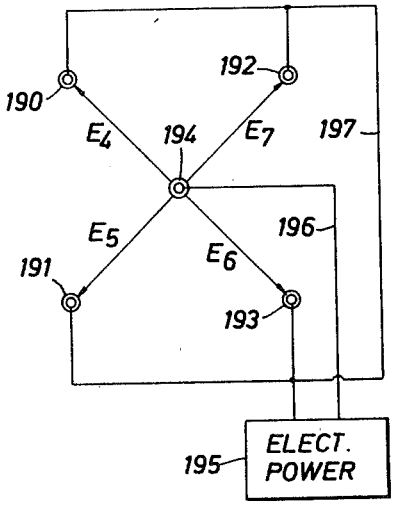
Figure 15:
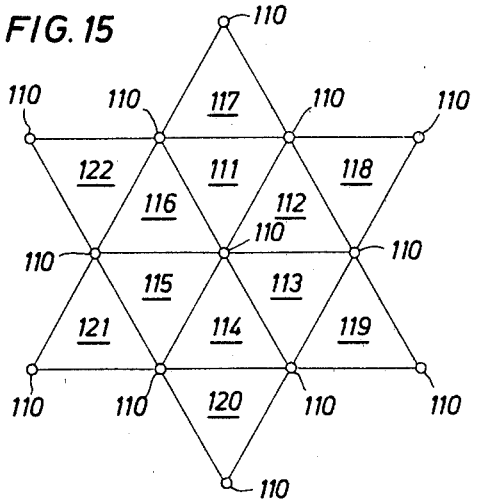
Figure 16:
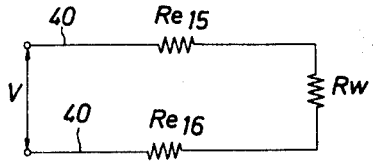
Figure 17:
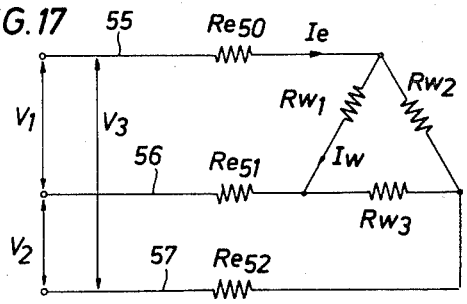
Figure 12:
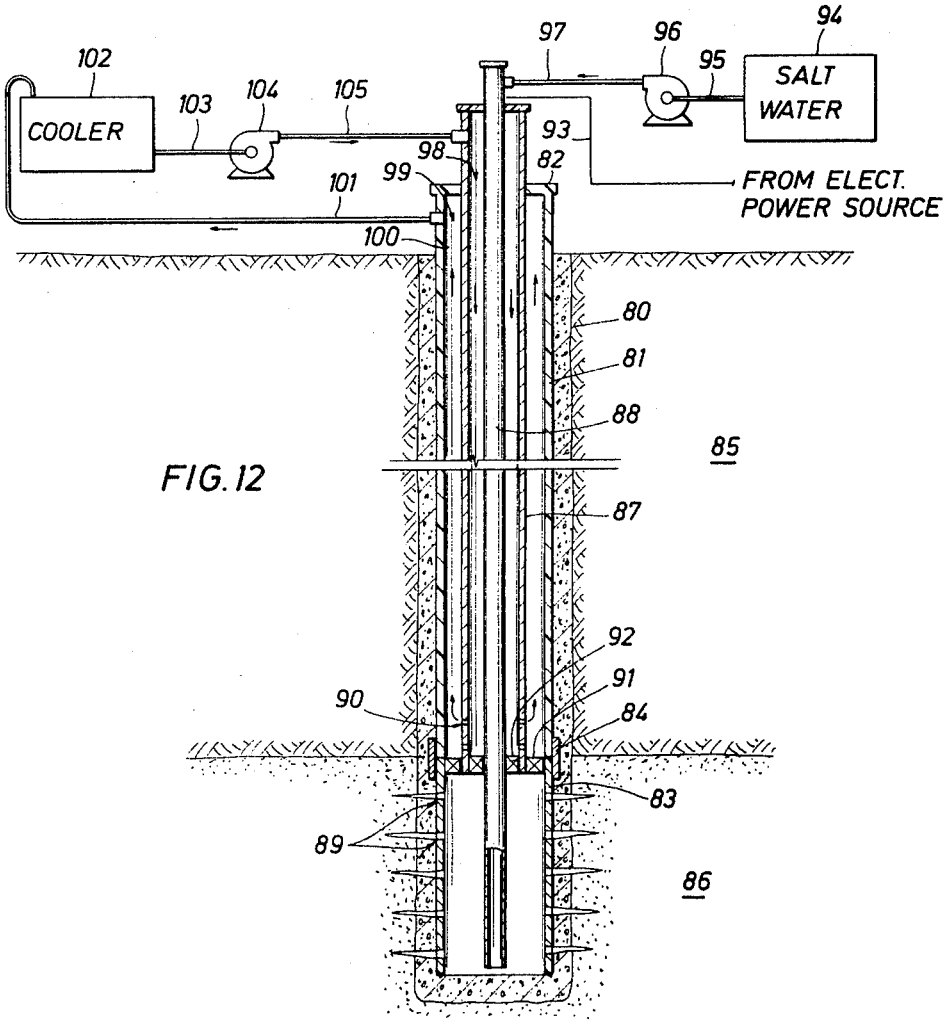
Figure 13:
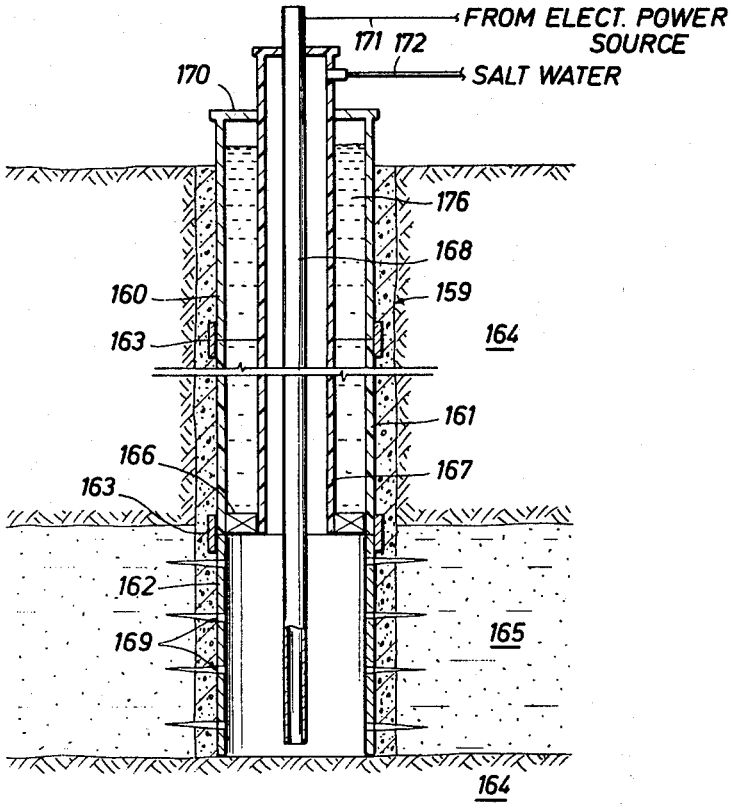
Figure 14:
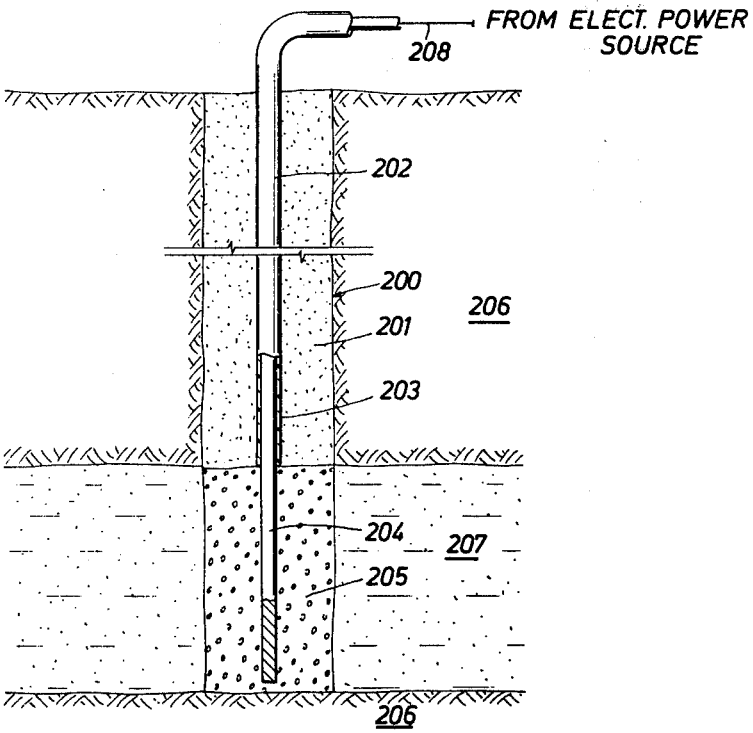
Figure 19:
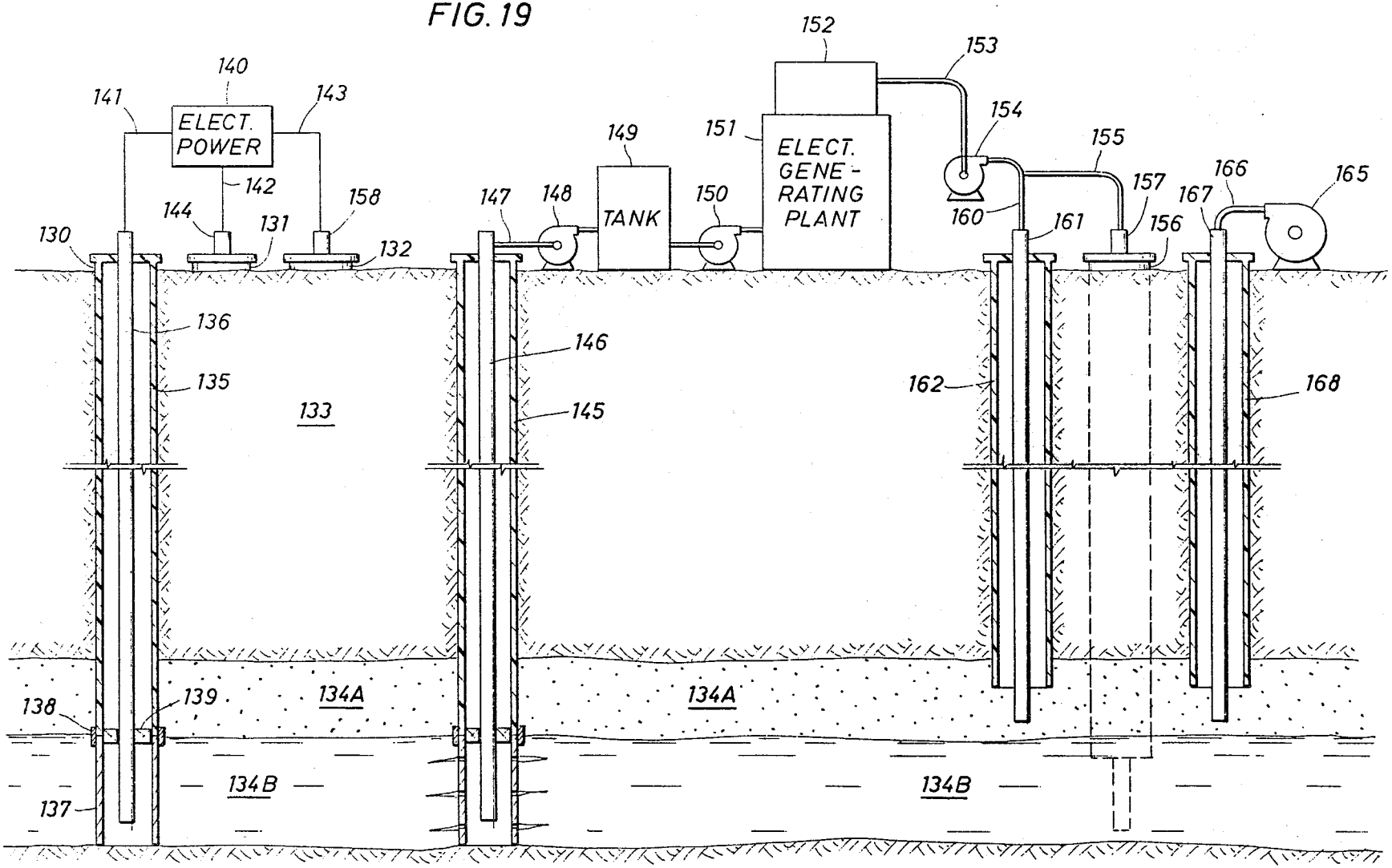
Figure 20:
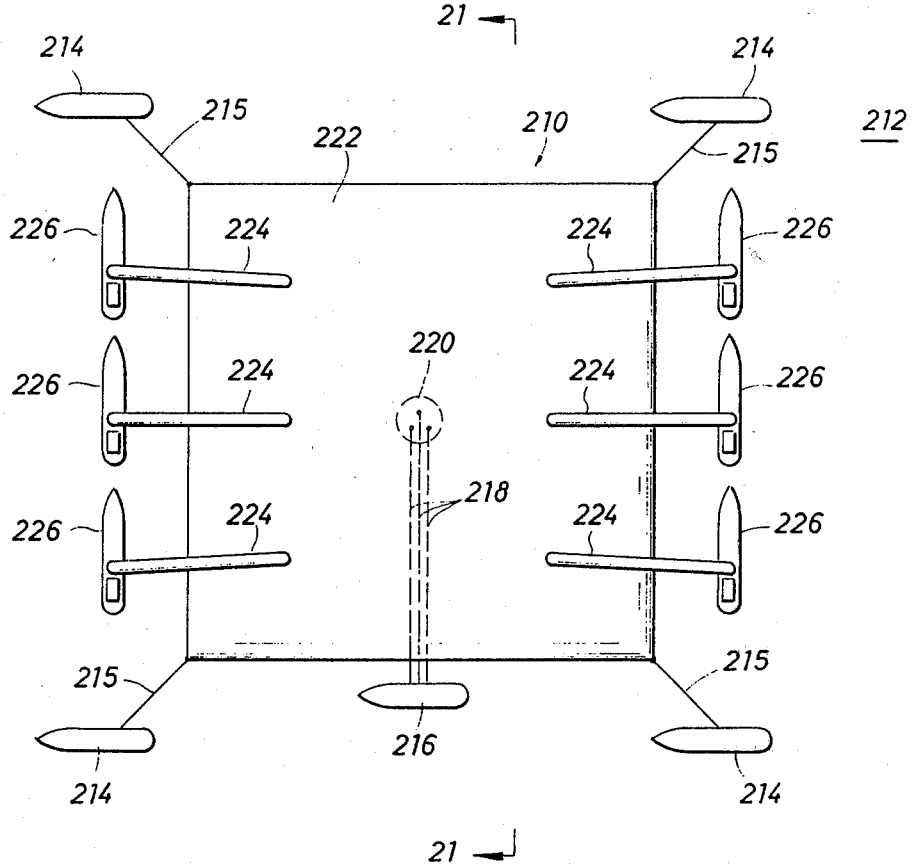
Figure 21:
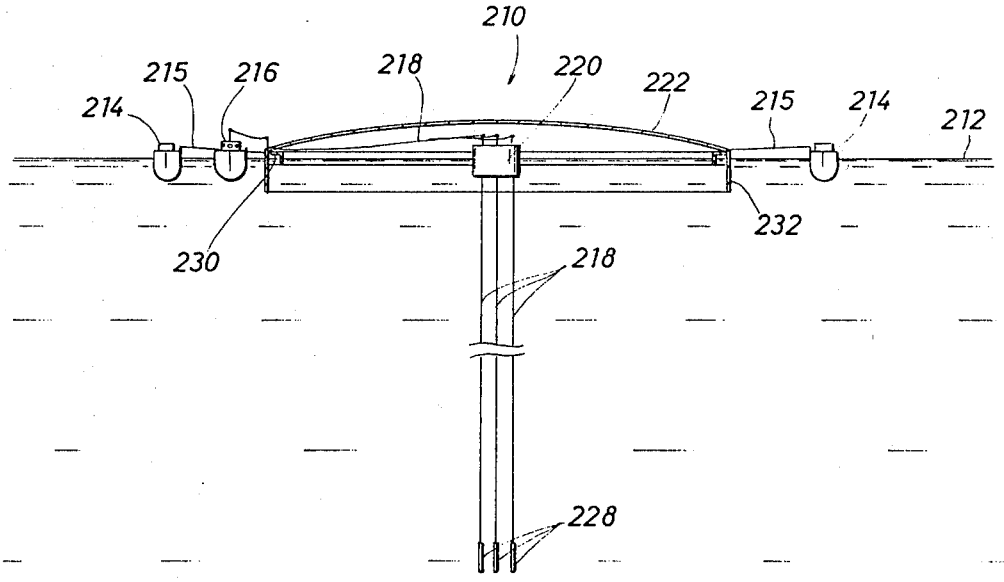

FIG. 1 is a cross-sectional view illustrating a pair of electrode well bores penetrating an oil-bearing formation for passing electric current therethrough in accordance with one embodiment of the present invention;

FIG. 2 is a diagrammatic view showing one suggested distribution of electrode wells in accordance with a second embodiment of this invention, with the electrode wells shown in relation to conventional oil-producing wells;

FIG. 3 is a cross-sectional view illustrating a pair of electrode well bores penetrating an oil-bearing formation adapted for passing an electric current therethrough in accordance with the second embodiment of the present invention;

FIG. 4 is a fragmentary detailed view of another embodiment of the apparatus disposed in a borehole shown in FIG. 3 penetrating the oil-bearing formation;

FIG. 5 is a diagrammatic view showing a second suggested distribution of electrode wells in accordance with a third embodiment of this invention with the electrode wells shown in relation to conventional oil-producing wells;

FIG. 6 is a diagrammatic view illustrating lhorizontal AC current distribution in a subsurface formation between a pair of electrode wells as shown in FIG. 2;

FIG. 7 is a diagrammatic view illustrating horizontal AC current distribution in a subsurface formation between three electrodes utilizing three-phase AC current as shown in FIG. 5;

FIG. 8 is a diagrammatic view, partly in cross section, illustrating a plurality of electrode well bores penetrating an oil-bearing formation in accordance with the embodiment illustrated in FIG. 5 and illustrating the relationship between the electrode well bores and producing well where the oil and salt water have been released from the formation matrix;

FIG. 9 is a diagrammatic view showing a third suggested distribution of electrode wells in accordance with a third embodiment of the invention;

FIG. 10 is a diagrammatic view showing a fourth suggested distribution of electrode wells in accordance with a fourth embodiment of the invention;

FIG. 11 is a cross-sectional view illustrating one embodiment of the apparatus for equipping an electrode well bore penetrating an oil-bearing formation;

FIG. 12 is a cross-sectional view illustrating another embodiment of the apparatus for equipping an electrode well bore penetrating an oil-bearing formation;

FIG. 13 is a cross-sectional view illustrating yet another embodiment of the apparatus for equipping an electrode well bore penetrating an oil-bearing formation;

FIG. 14 is a cross-sectional view illustrating still another embodiment of the apparatus for equipping an electrode well bore penetrating an oil-bearing formation;

FIG. 15 schematically illustrates one manner in which the principles of the present invention can be applied to produce a series of AC current-producing patterns for passing electric current through an increasing and expanding area of an earth formation;

FIG. 16 schematically illustrates the path for flow of current in accordance with the embodiment of the invention illustrated in FIG. 2;

FIG. 17 schematically illustrates the path for flow of current in accordance with the embodiment of the invention illustrated in FIG. 5;

FIG. 18 is a diagrammatic view, partly in cross-section, illustrating a plurality of electrode well bores penetrating an oil-bearing formation, a producing well bore penetrating the oil bearing formation, and an industrial plant utilizing an oil-fueled energy source with the exhaust gases from the plant being injected into the oil-bearing formation through yet another well bore penetrating said formation;

FIG. 19 is a diagrammatic view, partly in cross-section, illustrating another embodiment of the flue-gas injection system shown in FIG. 18;

FIG. 20 is a top view of a methane collection system according to one embodiment of the present invention;

FIG. 21 is a cross section of a methane collection system; and

Figure 22:
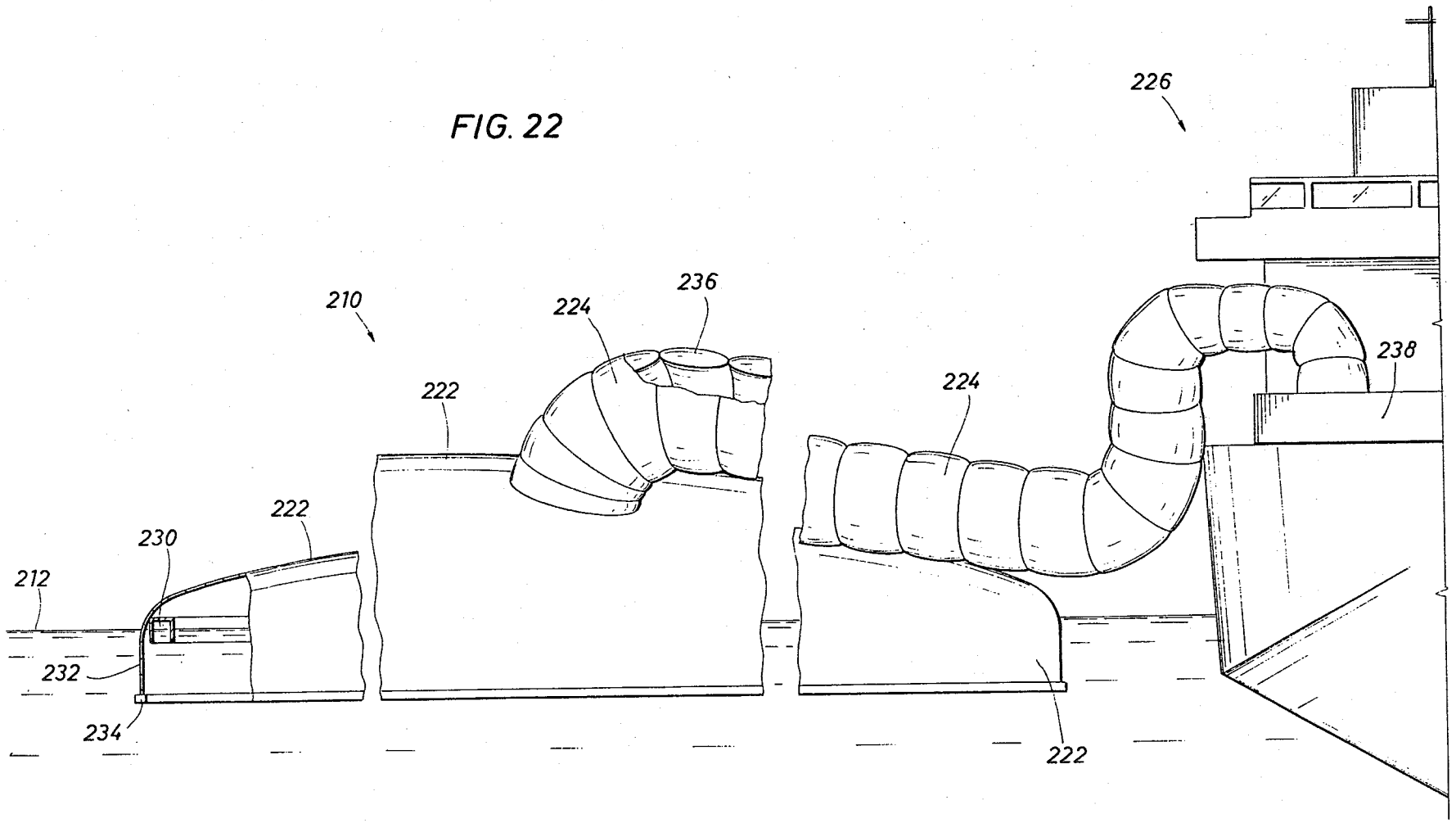

FIG. 22 is a pictorial illustration in partial cut-away of a methane collection system.

DETAILED DESCRIPTION OF THE PREFERRED EMBODIMENTS

For an oil formation or reservoir to be productive, a couple of conditions must exist. First, a pressure differential must exist between the formation and the well bore. Energy for the pressure differential may be supplied naturally in the form of gas, either free or in solution, evolved under a reduction in pressure. The energy may involve a hydrostatic head of water behing the oil, or the water under compression. In cases where the natural energy forces within the formation are not sufficient to overcome the retarding forces within the formation or reservoir, external energy must be added. Secondly, the produced oil must be displaced by another fluid, either gas or water.

Reservoirs are ordinarily classified according to the type of reservoir energy that is available. The four types are: solution gas drive reservoirs, gas expansion reservoirs, water driving reservoirs, and gratitational drainage reservoirs. A particular reservoir may, of course, involve more than one of these producing mechanisms.

In those cases where the natural energy of the reservoir is insufficient to overcome the resistive forces such as the forces of viscous resistance and the forces of capillary action, external energy must be applied. To illustrate such cases, this phenomenon is typically encountered in shallow formations containing high-viscosity oil that has little or no reservoir energy or formation pressure available, and in those oil-producing formations in which the reservoir energy has been completely depleted or dissipated. In this discussion, we have been referring to "mechanical" forces acting within the producing formation. In a formation in which the natural energy of the reservoir has been depleted, the mechanical forces in the formation have reached near equilibrium and no pressure differential is available to drive the oil from the formation into the well bore. In all of the cases where reservoir energy was depleted by conventional primary production, or nonexistent in the first instance, the energy balance of the producing formation remains undisturbed and in virtual equilibrium.

Artificial forces introduced into the reservoir, such as water or gas through various "pressuring" or "flood" techniques of secondary recovery, can effect a mechanical change in the formation by way of pressure. Steam pressure is likewise effective, with some benefits from heat. Combustion of some of the oil in the formation through "fire-flooding" and heating a well bore serve to reduce the viscosity of the oil in place and enhance flow characteristics, but lack driving energy to force the oil through the formation and into a producing well bore. However, these are primarily mechanical forces applied and operating only on an exposed face or surface of the formation, and if some chemical or molecular change is accomplished in the fluids in the formation, it is limited to a localized phenomenon. The instant invention provides yet another, or "tertiary", technique to enhance the flow characteristics of the oil in the formation and generate energy in the form of gas produced in the formation for increasing the formation differential pressure and reducing the viscosity of the oil and thus aiding in the production of oil from the formation. These factors are achieved by applying an AC electrical current to the formation resulting in an electro-chemical action on the fluids in the formation as will hereinafter be further described.

Referring now to FIG. 1, there may be seen a simplified diagrammatic illustration of a portion of a subsurface earth formation 18 containing both oil and salt water. More particularly, the formation 18 may be seen to have been penetrated by three separate boreholes 10, 11 and 14. Two of these boreholes, 10 and 11, are preferably lined with an electrically non-conductive or insulating casing 12, whereas the third or producing borehole 14 may be lined with conventional steel casing 13. Because of the action of the force of gravity, it will be noted that the oil in the formation 18 will usually tend to collect in the upper reaches or strata 19 of the formation 18, whereas the salt water, which is heavier than oil, will tend to collect in the lower portion or strata 20 of the formation 18 beneath the oil. Accordingly, the electrically non-conductive casing 12 in the two boreholes 10 and 11 will preferably be provided with perforations 21 at a level in the lower salt water zone or strata 20 of the formation 28, whereas the steel casing 13 in the third well 14 will preferbly have perforations 22 at an upper level in the oil zone or strata 19 of the formation 18. Thus, only the salt water 28 in the formation 18 will tend to enter and at least partially fill the casing 12 of the two boreholes 10 and 11.

Referring again to FIG. 1, it may be seen that a pair of metallic electrodes 15 and 16 have been inserted to a depth in each of the two wells 10 and 11, whereby their lower ends are each deeply immersed in the salt water which is collected in the casing 12. The upper ends of both elecrtrodes 15 and 16 are connected by suitable leads 26 and suitable regulating and control equipment 24 and 25 to an electrical power supply 23 by means of conductors 27. The electrical power supply 23 is of appropriate size and capacity for generating electric current that may be conducted into the contents of casing 12 and into the salt water zone 20 of the formation 18. Power supply 23, control means 24 and 25 and conductors 26 and 27 are fully insulated from the earth formation 17 to isolate the electrical current path in the formation 18.

Oil is a poor conductor of electricity, while salt water disposed in a formation is a good conductor. Since an electric current will follow the path of least resistance, current which is applied to the electrodes 15 and 16 from the power supply 23 will flow directly across the salt water zone 20 of the formation 18 between the two electrodes 15 and 16, and the salt water therein will tend to be heated in accordance with the amount of salt water which is interposed therebetween and the magnitude of current being applied to the electrodes 15 and 16. The heated salt water will act as a heating element with respect to the oil in the zone or strata 19, whereby the viscosity of the oil may be decreased, thus enhancing the flow characteristics of the oil in the formation.

The above discussion relating to FIG. 1 assumes a heating of a defined salt water strata in an oil-bearing formation which will heat the overlying oil strata, thereby lowering the viscosity of the oil and improving its flow characteristics in the formation. However, if a natural driving energy is not present in the reservoir or formation, lowering the viscosity of the oil will not greatly enhance oil production, since there is no formation pressure or force available to move the oil from the formation to the bore hole. For reasons to be hereinafter further described, transmitting an AC electrical current through the formation fluids, such as salt water of strata 20 of formation 18, will generate volumes of gases within the formation 18 by electro-chemical action for providing internal formation pressure to drive the oil into producing borehole 14 of FIG. 1, and reduce the viscosity of the oil and thereby enhancing its "flow" characteristics.

Referring now to FIGS. 2, 3 and 4, another embodiment of the apparatus is disclosed. A pair of boreholes 30 and 31 are shown penetrating the overlying earth 34 and an oil-producing earth formation 37. Boreholes 30 and 31 are preferably lined with an electrically non-conductive casing 35 and conventionally cemented down to the point at which the earth 34 adjoins the oil-bearing formation 37. In the embodiment of FIG. 3, the boreholes are completed "barefoot," that is, no casing is set in the oil-bearing formation 37 and the borehole is left unlined. In FIG. 4, another embodiment is shown, where a steel casing section 36 is set in the borehole in formation 37 and has perforations 42 completed therein. Collar 43 couples the insulating casing 35 and steel casing 36. The steel casing 36 can be anchored by a conventional cement plug 44.

A pair of metal electrodes 38 and 39 are inserted one into each of boreholes 30 and 31, respectively, and extend through the insulating casing 35 into the oil-bearing formation 37 as shown in FIG. 3, or into the steel or electrically conducting casing section 36, as shown in FIG. 4. The electrodes may be centralized within insulating casing 35 by means of packers (not shown in FIG. 3) and within the electrically conducting casing section 36 (see FIG. 4) by means of a packer 41 that is set just below the joint of the insulating casing 35 and the electrically conducting casing 36 for purposes to be hereinafter further explained. Electrical power is provided by generator 32 and is connected to electrodes 38 and 39 by means of conductors 40. Suitable regulating and timing apparatus 46 may be utilized to regulate the electric power and to time the length of the application of power to the formation, as will hereinafter be further explained. As hereinabove described, power source 32, control equipment 46 and conductors 40 are insulated from the earth 34 to insulate the electrical current from ground and provide the only path through the oil formation 37.

Formation 37 may contain many conductive elements, but the salt water ordinarily associated with oil-bearing formations is highly conductive. Such salt water, called "connate" salt water, is often distributed throughout an oil-bearing formation such as formation 37 because of capillary action in spite of gravitational forces tending to remove the water to the bottom of the formation. The sand grains of the oil-bearing formation matrix retain a film of salt water which, in turn, attracts a film of oil. Although oil is a poor conductor of electricity, the connate salt water distributed throughout the formation is capable of transmitting an electric current.

As may be seen in FIG. 3, the boreholes 30 and 31 allow oil and salt water from formation 37 to enter the boreholes and make contact with electrodes 38 and 39. Upon application of the AC electrical current from generator 32 to electrodes 38 and 39, an electric current is passed between electrodes 38 and 39 through the oil-bearing formation 37 in substantial isolation from the earth 34 above and below formation 37 by means of the connate salt water contained within the formation acting as an electrolyte. In the embodiment of FIG. 4, because of the effective electrical contact between the ends of electrodes 38 and 39 within steel casing section 36 and the salt water within the casing and in contact with the electrode, the effective side of the electrode is increased to the diameter of the electrically conducting casing 36, which is advantageous as will hereinafter further be described.

The heating of the salt water within boreholes 30 and 31 or in casing section 36 by the action of the electrical current will raise the temperature of the salt water appreciably, often to 200° F. or greater. Often the pressures in the formation can drive the heated fluids from the formation up into the casing 35. The temperatures of such heated fluids can have a damaging effect on the non-conductive casing 35, which can conveniently be fiberglass casing, causing it to warp or buckle and collapse if the temperatures rise appreciably over 200° F. In the embodiment shown in FIG. 4, the packer 41 seals the annulus between casing 36 and electrode 38 and prevents hot salt water from expanding up into casing 35 and damaging the lower end of the casing.

In some cases it may be necessary to replenish the salt water in electrically conducting casing 36 and in the formation 37 surrounding casing 36. In that event, the solid electrodes 38 and 39 shown in FIG. 3 may be replaced with a hollow tubular member acting as an electrode, such as jointed strings of tubing. Thus salt water at the surface of the borehole may be introduced into the conductive casing 36 and formation 37 through such a tubing string electrode to enhance the electrical contact between the electrode and the formation 37.

The electrical current source 32 may conveniently be a single-phase AC source of electric power. In a preferred embodiment of the present invention, a polyphase AC power source is used. When the source of AC electrical power 32 is connected between conductors 40 and electrodes 38 and 39, AC current will flow through a series path comprised of conductor 40, the resistance of the electrode 38 designated $R_{e38}$, the resistance of the water in the oil-bearing formation 37, designated $R_w$, the resistance of the electrode 39, designated $R_{e39}$, and conductor 40, as shown in FIG. 16. The current flowing in this circuit can be expressed mathematically as:

$$I = \frac{V}{R_{e38} + R_{e39} + R_w}$$

and the power dissipated in the water will, of course, be equal to $I^2R_w$. It will, therefore, be apparent that it is very desirable that the resistance of the water providing a conductive path between electrode 38 and electrode 39 have a high resistance as compared to the total series resistance of the electrodes, $R_{e38}+R_{e39}$. In fact, to achieve this relationship in some instances it may be desirable to utilize electrodes formed of aluminum or similar material characterized by a lower resistivity than steel. The current flowing through the circuit can be controlled by varying the supply voltage potential by means of regulating apparatus 46 or by varying the resistivity of the water. The power dissipated in the water, acting as a resistor, is manifested in the form of thermal energy or heat which is in turn distributed to the formation. As the salt water temperature rises, the resistance of the salt water declines, thus allowing a greater current to flow through the formation.

The flow of AC current between electrodes 38 and 39 through the connate water in the oil-bearing formation 37 will produce an AC electrical current flow through the oil-bearing earth formation 37, since the overlying or underlying earth structures 34 are fully insulated from electrodes 38 and 39 by casing 35. Accordingly, the AC electrical current flow will be substantially confined to the oil-bearing formation 37 due to the insulation of the earth formation 34 from electrodes 38 and 39 and the insulation of conductors 40, regulator 46 and power supply 32 from ground 34 as previously described. The action of the electrical current passing through earth formation 37 will heat the formation due to the resistance of the salt water, and, because of electrochemical reactions with constituent elements of the earth formation 37, such as salt water and oil, enhance the flow characteristics of the oil. In addition, the electrochemical reactions will provide increased internal pressure within the formation 37 to drive the oil into a producing borehole, such as boreholes 33 in FIG. 2, remote from electrode boreholes 30 and 31. The AC current conduction pattern will cover a lateral area within the earth formation 37 much greater than the area defined by the direct path between the spaced boreholes 30 and 31.

The electrochemical action of the AC electrical current will produce at least the following known phenomena:

1. Reduction in the viscosity and specific gravity of the oil in the formation, thus enhancing the flow characteristics of the oil;
2. Generation of large volumes of free gas in the formation due to electrochemical action with the oil and salt water in the formation;
3. Release of the oil and water from the earth formation matrix; and
4. Production of heat in the formation matrix in the area traversed by the current.

It is well known that the apparent specific gravity and viscosity of oil will decrease with a corresponding increase in the temperature of the oil, while the API gravity increases. In addition, the passing of an AC current through the formation apparently causes electrochemical actions that change the chemical properties of the oil to decrease the specific gravity and viscosity of the oil and increase the API gravity beyond the degree that can be attributed to heat alone.

Tests in the field, utilizing the two-well, single-phase AC power installation, as shown in FIGS. 2 and 3, have resulted in significantly elevated formation pressures, up to a 300 psi increase, over a large area, approximately 600 acres or more, as remote as 4,000 feet from the electrode well installations. In addition, many remote, open producing wells also produced a clear burning, volatile gas that it is believed contained methane and free hydrogen. The electrode boreholes 30 and 31 were spaced 100 feet apart in formation 37 that was tested to contain 1,500 barrels of oil and 2,300 barrels of saline water per acre foot. The power input to the two electrodes 38 and 39 average approximately 600 volts at 300 amperes. After a few days, increased pressures and increased production resulted in producing wells 600 to 800 feet away, and within 60 days of near continuous operation, increased pressures and production were observed in production wells 4,000 feet from the electrode boreholes after application of 120,000 kw to the formation 37.

A substantial pressure was maintained in some of the producing wells even after the electrode wells had been shut down for as long as thirty days. This result was achieved after some 120,000 kw of electrical power were injected into the producing formation. Such production of free gases within the producing formation can provide energy within the formation to repressure the reservoir if the natural energy of the reservoir is insufficient to overcome the resistive forces such as the forces of viscous resistance and the force of capillary action.

The source of the gases generated in the formation and the reasons for its production are not fully understood at this time. But several explanations based on laboratory experiments may be offered. They are:

(a) production of free hydrogen and oxygen by electrolysis of the salt water contained in the formation;
(b) chemical action of hydroxides, resulting from electrolysis of the salt water, acting on the oil in the formation;
(c) direct molecular conversion of large oil molecules to hydrocarbon gas molecules such as methane;
(d) release of gas molecules in solution in the salt water present in the formation;
(e) release of solution gases by heat, such as methane and carbon dioxide, present in the oil;
(f) release of solution gases in the oil by the "stripping" action of free hydrogen and oxygen and any steam produced in the formation as a result of heat;
(g) formation of hydrocarbon gases as a result of hydrocracking and subsequent hydrogenation of the oil by free hydrogen gases;
(h) formation of carbon dioxide by the action of nascent oxygen reacting with the carbon molecules in the oil; and
(i) formation of carbon dioxide by action of nascent oxygen combining with carbonates commonly present in the salt water on the formation matrix in some oil-bearing formations.

It is also well known that heating of oil in the formation will release solution gases from the oil and salt water. Thus, in the heated areas of the formation solution gases such as methane gas and carbon dioxide dissolved in the oil will be released. But the large pressure increases encountered in the field under actual tests over widespread distances and the results of lab tests cannot be accounted for solely on the basis of release of solution gas by thermal action.

Laboratory tests have shown that an oil and salt water mixture will produce, under the action of an AC electrical current, large volumes of free hydrogen and carbon dioxide, and lesser volumes of free oxygen, methane, ethane, propane, and butanes plus. The free hydrogen and oxygen are the result of AC disassociation of the salt water, which will be hereinafter discussed in greater detail. With nascent oxygen generated by such AC disassociation of water, the presence of the carbon dioxide could be the result of (h) or (i) above. Some of the hydrocarbon gases may be the result of hydrocracking and hydrogenation of the oil by free or nascent hydrogen as described in (g) above.

In direct molecular conversion of a hydrocarbon molecule chain to form molecules of hydrocarbons that remain in liquid form and others that take the form of gaseous hydrocarbons, the AC electrical current is acting directly on the hydrocarbon molecules to cause the conversion or breakdown for reasons not presently fully appreciated. But this phenomena could account for a substantial part of the hydrocarbon gases produced in the formation.

Methane is slightly soluble in water, due to a slight attraction between methane molecules and water molecules. However, it is known that carbonates and bicarbonates present in the water will increase the solubility of methane in the water. In the formation matrix, the connate water molecules collect around methane molecules to form a cagelike film held together by hydrogen bonds. Since the water molecules have an unusually large dipole moment (1.8 Debye units), the molecules rotate in response to an impressed electric field. The exposed hydrogen protons of the water molecules turn toward the negative potentrial of the electrical field. This rotation of the water molecules in response to an electrical field can break the hydrogen bonds between the water molecules, thus releasing the methane molecule. This chemical action of releasing the methane molecules trapped in the connate salt water would also generate heat, which indicates that a heating effect due to chemical reactions also takes place in the formation traversed by the current.

AC DISASSOCIATION OF WATER

In a conventional 60-cycle alternating current (AC), the applied emf fluctuates from plus (+) to minus (−) polarity 60 times per second, varying as the well-known sine wave. Thus during half a cycle, one hundred-twentieth of a second, the voltage rises from zero to a peak value then falls again to zero. During the next half cycle the voltage becomes negative, reaches a minimum, numerically equal to the positive peak, then rises back to zero and repeat itself in the next cycle. This alternation of polarity results in a back-and-forth motion of the electrons in the lead wires to the electrodes. Thus, the conduction electrons in the wire only move minute distances back and forth. Nevertheless, this vibratory motion constitutes the alternating current. This oscillation causes the electrodes to become "positive" or "negative" depending on whether the electrons in the connecting wire are moving away or toward the electrode, respectively. The motion of electrons away from one electrode corresponds to a motion of electrons toward the other electrode. Hence the electrodes alternate in polarity from "positive" to "negative" sixty times per second.

This alternation of electrode polarity results in an alternating attraction and repulsion of the + ions in the electrolyte. In a salt water solution there are $Na^+$ and $Cl^-$ ions. Some of the $Na^+$ ions drawn to the negative electrode are neutralized to Na atoms during one half cycle. The next half cycle, when the electrode is positive, the $Na^+$ ions are repelled and some of the $Cl^-$ ions are neutralized to Cl atoms by the removal of electrons. The chemical reaction at the electrodes during AC disassociation of salt solutions thus depends on the interaction of free sodium and chlorine atoms and the adjacent atoms both in the electrolyte and in the electrodes.

Basic stides of these electrode interactions are reported mainly in the literature of fifty years ago. These observations were related to such diverse research as the behavior of bacteria under the action of electric fields, the generation of explosive gases in electric boilers and the influence of alternating currents on the corrosion of underground steel pipes and cables. These papers establish several basic principles of "AC electrolysis":

(1) There is a crictical alternating current density, $j_o$, in amperes/cm$^2$ below which no disassociation of the water molecule into free $H_2$ and O occurs at the electrodes;

(2) Above $j_o$, AC disassociation of water into free $H_2$ and O generally follows the Faraday law of DC electrolysis;

(3) The value of $j_o$ depends on the composition of the electrolyte and of the electrodes. It is attributed to the capacity of the electrodes to store the products of electrolysis which in turn depend on the nature and condition of the electrode surface and the type of electrolyte present;

(4) In some experiments it was observed that an excess of free hydrogen was generated over stoichiometric volumes of oxygen in the evolved gases; and (5) It was also reported that generation of gas was accomplished by the disassociation of water due to arcing between the electrodes and the electrolyte. Under certain conditions it was found that the decomposition of water by arcing was more than five times that by electrolytic disassociation with the same current and over the same time period.

The most pertinent papers found in this field and which relate to the above findings are:

1. Shipley, "The Alternating Current Electrolysis of Water", *Canadian Journal of Research,* Vol. 1, pp. 305–358 (1929);
2. Shipley and Goodeve, "The Law of Alternating Current Electrolysis and the Electrolytic Capacity of Metallic Electrodes", *Trans. Am.* Electrochem. Soc., Vol. 5, 375–402 (1927);
3. Marsh, "On Alternating Current Electrolysis", Proc. Royal Soc., London, Vol. 97A, 124–144 (1920).

Marsh related the quantity of evolved gases to the current density of the AC current in the electrode. He suggested that some of the gas liberated in any half cycle is retained at the electrode and is then attacked by gas ligerated in the succeeding half cycle and the reformation of water. He also noted that the total volume of gases liberated was less than that predicted on a theoretical basis.

Shipley and Goodeve discuss the generation of gases by AC electrolysis as the result of the actions of an alternating current being a series of equal and opposite direct currents which should liberate on the electrodes its equivalent of hydrogen and oxygen according to Faraday's law. One ampere of DC current in one minute produces 10.4 cc. of electrolytic gas at standard conditions, in accordance with Faraday's law. Therefore, one ampere of an AC current should theoretically produce 9.42 cc. per minute. One electrode should produce 4.71 cc. of electrolytic gas per minute. This can be represented by the equation:

$$R = 4.71\, I_F$$

In all cases in the research by Shipley and Goodeve, it was found that the AC current produced less gas than that required by Faraday's law. The rate of evolution was found:

(1) to be a function of the current density, when the current density was maintained uniform over the surface of the electrode;

(2) to increase in direct relation with the increasing current density above the critical point; and (3) to follow with few departures a straight line curve parallel to Faraday's law.

The critical point was found to depend on the nature of the metal electrode, the coating on the surface of the electrode and the temperature of the electrode and electrolyte.

The data from Shipley and Goodeve reflected the yield of gas from soft iron electrodes as 10 cc/cm$^2$ and dropped to zero below current densities of 3.8 ampere/cm$^2$. Above this critical current density the increase in gas yield was about 4 cc./minute for unit current increase in fair agreement with the 4.7 cc./minute required by Faraday's law. It was also noted that the yield and critical current density of steel is nearly the same as for soft iron. Values between those found for soft iron and steel would be expected to apply in the present invention where field tests as in FIG. 3 using steel sucker rods for electrodes 38 and 39 and perforated steel casing 36 as combination electroddes as shown in FIG. 4. At 1,000 amperes of current, the critical density (4 amp/cm$^2$) would be exceeded only if the surface area of the electrodes 38 and 39 in contact with the electrolyte in formation 37 were less than 250 cm$^2$. Such a current density was not achieved during the tests above described. On this basis, appreciable gas generation within the electrode wells would not be expected. This suppression of gas generation in the electrode wells 30 and 31 is one of the important features of the present invention.

Although the prior research papers speak of the phenomenon of "AC electrolysis" of water, Applicant prefers to define the phenomena as "AC disassociation" of water. Accordingly, the term "AC disassociation" of water, as used herein, includes the classical definition of "electrolysis" for decomposition of water due to polar effects of the electrodes on charged electrolyte ions, but further includes all other physical and chemical phenomena effecting an electrolyte due to the physical and electrical phenomena associated with an AC current. In the classical electrolysis of an electrolyte comprising sodium chloride and water, two volumes of hydrogen is liberated to one volume of oxygen, and free chloride gas is liberated, while in all field and lab tests to date, Applicant has yet to detect the release of chlorine gas, and the ratio of free hydrogen to oxygen gases liberated is always higher than predicted. Although, the lower ratio of hydrogen to oxygen gases has been found in earlier lab work, no definitive explanation has yet been offered as to what chemical reactions prevent the liberation of chlorine gas. Further, the effects of other alternating current phenomena such as extremely low and high frequency effects, AC electrical field strengths, AC current density in microscopic pore spaces, AC current effects in conductive earth formation mediums such as shales and AC magnetic field density effects are not believed predictable under the classical "electrolysis" theories.

By a classical "electrolysis" theory is meant a definition such as the following:

Electrolysis: "decomposition by means of an electric current; the compound is split into positive and negative ions which migrate to and collect at the negative and positive electrodes"

*Condensed Chemical Dictionary,* 6th Ed., Reinhold Publishing Corp. (1961). Such a definition is obviously based on traditional DC decomposition theory, but fails to take into account all other physical and chemical effects that may be taking place due to the special effects peculiarly associated with AC current theory.

DISTRIBUTED GENERATION OF GASES

Field experimentation using the methods and apparatus which are the subject of the present invention have yielded some results which may be at least partly explained by the AC disassociation theory of water. In particular, it has been observed that the electrode boreholes apparently remain relatively free of evolved gases while the reservoir pressure is increasing at locations remote from the electrode boreholes. If the injection current continues to increase, and the critical current density at the electrodes is reached, then gas could begin to evolve in the electrode boreholes. Assuming that a first current is chosen where gas does not evolve from the electrodes, the current density is determined by the surface area of the electrode and thereafter by the relative surface area of the electrolyte.

As hereinabove explained, the naturally occurring connate water in the oil-bearing formation is confined to a capillary film surrounding the sand grains of the formation forming what is referred to as "water-wetted" sands. Accordingly, if a slice were made through the oil-bearing formation, a relatively small surface area of electrolyte per unit area of formation would be available in the formation compared to the electrolyte available in the electrode boreholes. Thus, a correspondingly higher current density is therefore present in the formation electrolyte at a given operating current level than in the electrode borehole electrolyte interfacing the electrodes. Thus, gases can be evolving throughout the formation even though gases are not observed in the electrode borehole.

It has also been observed, however, that larger volumes of gases evolve in the formation than are predicted solely by Faraday's law of electrolysis. Thus, a second disassociation mechanism encompassed within the hereinabove "AC disassociation" definition may be taking place. The electrolyte, generally a saline solution, has a "negative" temperature coefficient of conductivity where the conductivity actually increases with temperature. It can be seen that the electrical resistance of the electrolyte in the formation will result in heating of the electrolyte as current passes through the formation. The heated electrolyte has a lower resistance and a higher current will result for a given voltage gradient. Since power dissipation is proportional to the current at a given voltage, it is clear that a localized instability can be produced.

To further explain the phenomena of gas generation in the formation matrix, especially in attempting to explain the larger volumes of hydrogen and oxygen that can be produced over and above that predicted by Faraday's Law, another phenomenological theory has been developed. The specific assumption underlying this theory is that the action of AC in electrolytes can cause pores or bubbles in which electrolytic gases are released and in which electrochemical reactions can occur through arcing. It is often useful in mathematical physics to assume a particular geometry in order to derive the applicable equations. Later there is considerable simplification if the choice of geometry is not necessary. Such is the case in this theory of gas distribution.

Consider a cylindrical pore in the formation containing salt water of resistivity (R) of $\rho$ ohm-meter and density D kg/m$^3$ and specific heat $\sigma$ joule/kg °oC.

D=mass/volume—M/V in kg/m$^3$. The rate of heating can be expressed as:

$$dQ/dt=i^2R \quad (1)$$

where:

i=current in amperes

R=resistance in ohms

Ohm's law can be expressed as:

$$i=v/R \quad (2)$$

where:

$v$=voltage in volts

Electrical heating (P) can be expressed in the following equation:

$$P=i^2R \quad (3)$$

Substituting equation (2) in equation (3) results in:

$$P=\frac{v^2}{\frac{R^2}{R}}=v^2/R \quad (4)$$

The heat added to the pore can be expressed as:

$$dQ=M\sigma dT \quad (5)$$

and substituting from equation (1)

$$dQ/dT=M\sigma dT/dT \quad (6)$$

and $$dT/dT=i^2R/M\sigma \quad (7)$$

and substituting from (4)

$$dT/dT=v^2RM \quad (8)$$

The mass (M) of salt water in the pore can be expressed as:

$$M=DV \quad (9)$$

where:

$D$=mass/volume $V$=volume and the mass of a cylindrical pore would be expressed as:

$$M=DL\ (\pi d^2/4) \quad (10)$$

where:

$$V-L\ (\pi d^2/4) \quad (11)$$

and where:

L=length of pore=0.01 meter=1 cm d=diameter of pore=0.01 meter=1 cm

Using the definitions above for R, R can be expressed as:

$$R=\rho I/(\pi d^2/4) \quad (12)$$

Substituting values expressed in equations (11) and (12) into equation (8) the resulting equation is:

$$dT/dT=v^2/\rho\sigma DL^2 \quad (13)$$

Thus the rate of heating as expressed in equation (13) is independent of the diameter of the pore for a given potential gradient [v/L(length of pore)] and is inversely porportional to the product $\rho\sigma$D.

Assuming typical values for connate water of formation 37, the product $\rho\sigma$D can be expressed as:

$$\rho\pi D=10^{-4}\ (\text{ohm-m})\times 10^3\ \text{kg/m}^3\times 10^3\ \text{joule/kg}^\circ\ \text{C.} \quad (14)$$

The dimensions of voltage gradient are volts/meter, hence substituting into equation (13)

$$\begin{aligned} dT/dT &= \text{voltage gradient}^2/\rho\sigma D \\ &= (\text{volts/m})^2\ (\text{m}^2\ {}^\circ\text{C./joule-ohm}) \\ &= \text{joule/sec} \end{aligned}$$

$$\text{Therefore } dT/dT=(\text{voltage gradient}^2/400)\ {}^\circ\text{C./sec} \quad (15)$$

For a potential gradient uniform over a distance between electrodes of 200 feet (61 meters) and an applied potential of 800 volts (rms) as used in some field tests, the voltage gradient=(800/61)=13 volts/meter and the voltage gradient squared—172 (volt/m)$^2$. The resulting rate of temperature rise, neglecting heat losses to the rock matrix, would be dT/dt=172/400=0.43 °C./sec. At this rate the salt water in the postulated pore would reach the boiling point (pressurized), T=110° C. in about four minutes. This rapid rate of temperature rise corresponds to an almost adiabatic condition because of the low thermal conductivity of the adjoining rock materials.

Once the temperature of a particular pore exceeds that of the surrounding salt solution, the localized pore temperature tends to accelerate because of the negative temperature coefficient of conductivity. Thus, once a pore begins to heat it becomes more conductive and provides a preferred path for the current. Since the heating is proportional to the square of the current and the first power of the resistivity (inverse of conductivity), the rate of heating increases until the boiling point is reached and localized arcing occurs. Localized arcing appears to be an unstable condition, both at the electrodes and in the electrolyte, from visual observations in laboratory tests. It seems likely that this is a form of the familiar Taylor instability that is prevalent in plasma physics. The net result is that the arc is quickly quenched by the inflow of cooler electrolyte with a consequent shifting of the localized higher current to another area where the process is repeated. In this way the arcing action can spread over a large volume of reservoir giving a wide distribution of electrochemical action for producing gases.

It is theorized that the instability, hereinabove described, will finally result in very localized areas of steam formation where sufficient heating of the electrolyte occurs. The ionization potential for steam is significantly less than for water, such that the existing voltage gradients within the formation structure could ionize the steam with a resulting arc through the steam. The high temperatures produced by the arc would be sufficient to disassociate the water molecules in the vapor and produce large quantities of gases such as hydrogen and oxygen, in addition to gases evolved directly by AC disassociation.

The formation of steam would result in a sudden increase in electrical resistance in the localized area and the arc would discharge any stored charge so that a much lower electrical current would not be obtained. Accordingly, the steam could then condense until another unstable cycle begins.

However, field tests have not shown a significant increase in reservoir temperature remote from the electrode pattern. The field test utilizing the arrangement of FIG. 1, achieved only an 18° F. increase in the wellbore 14, and the electrode well temperature never reached a boiling point. No steam has ever been detected in the electrode boreholes or in any remote producing borehole. This does not negate the validity of any of the above discussed AC disassociation of water or the distribution of evolved gases in the formation, since the effects may be taking place in microscopic pore spaces and result in gas evolvement but little or no liberation of steam outside the pore space, and a very localized temperature instability.

In summary, the disclosed apparatus and method of producing gases in-situ in an oil-bearing or mineral formation serve to produce the following phenomena:

(1) the critical AC current density for the production of gases due to AC disassociation is exceeded in large volumes of formation between the electrode wells;

(2) the AC current density at the interface between the electrodes and the electrolyte is at or below the critical value for gas generation within the electrode wells;

(3) the potential gradient within the formation is sufficiently high and is spatially distributed to produce electrochemical action throughout a large volume of formation between the electrode wells; and (4) the electrochemical action generates gases, including some low molecular weight hydrocarbons, breaks physical and chemical bonds binding the oil to the rock matrix, and decreases the viscosity and specific gravity of the oil and in having its flow characteristics in the formation to producing boreholes.

As hereinbefore mentioned, laboratory experiments have shown that oil will be released from sand grains under the influence of an AC current, and it is believed that under certain conditions such action will take place in a reservoir formation. The reasons for this release of the oil and connate water from the sand grains in the presence of an AC current are not fully understood but may be the result of the rotation of the water molecules in the connate water under influence of the electric field, as hereinabove described, that break hydrogen bonds with the oil film that coats the connate water film that surrounds the sand grains of the formation matrix. Further, the release of methane molecules from the connate salt water, as above described, would also dislodge oil molecules from the residual oil film that coats the connate water film surface, thus dislodging both the methane molecules and the oil molecules to form gas for pressurizing the formation and for freeing oil molecules that will tend to move, because of gravitational forces, to the upper strata of the formation. The water freed of the formation matrix would tend to gravitate to the lower portion of the formation. Such a release of oil from the formation matrix, and gravitating to the upper strata of the formation, would make enhanced recovery of the oil a real possibility, particularly in formations where water is the driving force creating the reservoir energy.

As hereinabove discussed, significant quantities of $CO_2$ have been recovered from the reservoir through producing boreholes. In addition, the water produced with the oil from the effected formation contains increased concentrations of dissolved $CO_2$ which can be removed from the water. The quantities of $CO_2$ thus produced from the reservoir according to the present invention may be injected back into the reservoir to form a part of a tertiary recovery process.

The use of carbon dioxide to aid in oil recovery is well known and such use can substantially increase the yield over a standard waterflood. This improvement in recovery can be as much as 50 to 100%. Several mechanisms have been postulated as contributing to the increased recovery. One major factor is a reduction in viscosity of the oil where the $CO_2$ is injected at sufficiently high pressure to make it soluble in the crude oil. For example, up to 700 scf of $CO_2$ will dissolve in 1 barrel of oil, reducing the viscosity of the oil from 10 to 100 times, depending on the initial apparent viscosity of the oil. The reduced viscosity results in a greater mobility of the oil to improve its recovery characteristics.

In the above example, the dissolved $CO_2$ will also produce a volume increase of 10 to 40 percent in the oil. It is postulated that this volume increase can itself cause increased formation pressures to enhance recovery and can help to ensure continuity of the oil phase to prevent any by-passing of a subsequent "flood" to recover the oil. In addition, it is obvious that, if the same residual volume of oil remains after the selected recovery process, more oil will have been produced by the flood since the remaining volume will contain large quantities of $CO_2$.

The present invention is well suited for use with a $CO_2$ injection recovery process. One of the difficulties in using $CO_2$ is the lack of a supply of $CO_2$ at the injection site. Importing the quantities of $CO_2$ needed to flood a large field is very expensive and is subject to fluctuations in the available supply. However, the present invention produces large quantities of $CO_2$ in-situ as a by-produce which is immediately available at the production site. It should be apparent that the use of AC, as hereinabove described, greatly increases the production techniques available to the reservoir engineer to obtain maximum production from a given oil field.

It is anticipated that the gas generation, increase of formation pressure, enhancement of the oil flow characteristics, and separation of oil and water from the formation matrix effects can readily be combined with other available recovery techniques to further increase the percentage recovery of the oil in place. For instance, in formations where there is not readily available a naturally occurring electrolyte in the form of "water wetted" sands, and "oil wetted" sand formation may be first treated with selected injections to flood the formation with a suitable surfactant, such as a "detergent", to make the oil miscible in the water-based surfactant which would then act as the electrolyte in employing the present invention to enhance formation pressure and ultimate recovery.

With the production of gas within the oil-producing formation 37 (see FIG. 3), and the energy that the production of such gas imparts to the formation, it can be seen that the process can be utilized either in a single installation of a pair of boreholes as shown in FIGS. 2 and 3, or in a plurality of installations distributed within a given field or reservoir, to restore energy to the reservoir for creating a driving force for moving the oil from the oil-bearing formation into a producing well bore and improving the flow characteristics of the oil. As seen in FIG. 2, a typical electrode well installation having wells 30 and 31 will cause a resulting increase in formation pressure within the production formation, thereby enhancing the recovery of oil through producing wells 33. After substantial volumes of gas have been generated in the producing formation and an optimum formation pressure is achieved, the electrode boreholes 30 and 31 may have power shut off for predetermined periods and only operate for selected periods of time to maintain the desired formation pressure. Regulating and timing apparatus 46 (see FIGS. 2 and 3) can be utilized to regulate the current flow and automatically turn the current source off and on at desired intervals. Such regulation of the current flow can also be utilized to control pressures and temperatures in the electrode boreholes.

In summary, a subsurface formation carrying a naturally occurring material having a hydrocarbon constituent can be treated by establishing an AC electrical field within the formation generally defined by a plurality of spaced electrodes extending into the formation and by establishing in response to said electrical field a zone of electrochemical activity in the formation, the zone of electrochemical activity being generally defined by the electrical field and resulting in electrochemical reactions with constituent elements of the formation and the hydrocarbon material for producing gases in the formation to increase the internal pressure of the formation over an area exceeding the zone of electrochemical activity and to improve the flow characteristics of fluid hydrocarbon containing materials. In an oil bearing formation, the electrochemical reactions with salt water and oil in the formation increase the internal pressure of the earth formation by generating volumes of gas within the formation and further act to enhance the flow characteristics of the oil by lowering the viscosity of the oil. The oil can be withdrawn from the formation in response to the increased formation pressure and improved flow characteristics through a producing borehole penetrating the formation and spaced from the zone of electrochemical activity. Of course, oil could also be withdrawn within the zone of electrochemical activity.

Referring now to FIGS. 5 and 8, a diagrammatic view of the distribution of three electrode wells disposed in a triangular pattern in a field of oil-producing wells is shown. Three electrode wells 50, 51 and 52 are shown spaced in a triangular pattern, with AC electrical power supplied by source 53 and distributed to the electrodes in wells 50, 51 and 52 by conductors 55, 56 and 57, respectively. A regulator and timer apparatus 79 is connected to the power source for regulating the current through the boreholes. The electrode wells 50, 51 and 52 may be completed in the same manner as the electrode wells 30 and 31 shown in FIGS. 3 and 4, and the reference numbers in FIG. 8 relating to the electrode borehole 50 are identical to the reference numbers of borehole 30 shown in FIGS. 3 and 4. In practice, use of three-phase AC power, with each of the three phases connected to one of the electrodes of boreholes 50, 51 and 52, has been found to be more efficient than use of single-phase AC power in a two-well arrangement shown in FIG. 2, for reasons to be further explained. The three-well, three-phase AC electrode well installation shown in FIGS. 5 and 8 will cause the same electrochemical actions to take place in the formation 37 as those described with respect to FIGS. 2–4. In actual tests, substantial formation pressure increases were noted up to 8,000–10,000 feet away after operation of the three-well installation after only 40,000 kw were injected into the producing formation. This is about one-third of the total kw necessary to effect lesser pressure increases in utilizing the single-phase AC electrode installation as depicted in FIGS. 2 and 3. As previously described, current flow is restricted to formation 37 by insulating the boreholes 50, conductors 55, 56 and 57, power source 43 and regulating apparatus 79 from earth 34.

Referring further to FIG. 8, a producing well bore 180 is shown having a conventional casing 181 perforated in the upper strata 173 of formation 37 for reasons to be hereinafter further discussed. A tubing string 187, through which oil is to be produced from formation 37, is disposed in the borehole and centralized by packers 183 and 184. Pump 188 pumps oil through tubing 187 into a storage tank 189 in a conventional manner.

As hereinbefore discussed with relation to FIGS. 2 and 3, one of the phenomena occurring as a result of the electrochemical action of the AC electrical current is the separation of the oil and water from the formation matrix and the gravitation of the oil to an upper strata of the formation and the water to a lower strata of the formation. Accordingly, utilizing the three-well, three-phase AC power installation of electrode boreholes 50, 51 and 52 (FIG. 8) the passage of electrical current through formation 37 would release oil and salt water from the sand matrix of formation 37, allowing the oil to gravitate to an upper strata or level 173 while the water would gravitate to a lower strata or level 175. If producing well 180, remote from the electrode well installation, is completed in strata or level 173, then oil recovery would be enhanced, since no salt water from stata 175 would be produced.

Referring now to FIGS. 2, 5, 6 and 7, power distribution in the earth formation can be explained. In FIG. 6, assumed lines of current flow are illustrated for the two-electrode arrangement shown in FIG. 2. For simplicity all curves are assumed to be circles. Hence the lengths of the current paths can be calculated from measurements of the radii and angular lengths of arcs. Assuming the resistance to current flow is directly proportional to the length of the current path, then the power dissipated can be calculated as:

$$P = I^2R = \frac{V^2}{R} \tag{16}$$

where:

P is the power dissipated

I is the current

R is the resistance

V is the voltage impressed across the resistance

Substituting L (length of the current path) for R in equation (16):

$$P = V^2/L \tag{17}$$

the power at each circular arc relative to that along the direct line X between electrodes can be calculated.

Calculations show that greater than 50% of the power due to the current flow will be dissipated in a circle whose diameter is equal to the distance between the centers of the two electrodes, as can be seen in the circle shown at A in FIG. 6, thus causing a zone within circle A of great electrochemical activity, as hereinabove described in detail, reacting with the salt water, oil and other constituent elements of the formation. Of course, a great amount of power will be dissipated in the formation outside of circle A, and, correspondingly, electrochemical reactions are also taking place in this greater zone.

Referring to FIG. 7, a triangular spacing of electrodes is shown as in FIG. 5, with the application of threephase AC current to the three electrode wells. Here three overlapping circles B, C and D are shown as the greater than 50% power dissipation zones between each of the three wells. As can be seen by reference to FIG. 6, the three-well, three-phase arrangement treats over twice the area that can be treated by a single installation of two wells. In addition, the overlapping zones of the power distribution circles may enhance the electrochemical activity in those areas, thereby enhancing the results obtained.

In field testing the spacing between the two-well arrangement shown in FIG. 2 was 100 feet while the three-well pattern shown in FIG. 5 utilized a 200-foot spacing. From comparisons of FIGS. 6 and 7, it can be seen that the area of formation treated by the electrical field and the established electrochemical zone of activity for a three-electrode, three-phase AC arrangement will be much larger than the area created by a two-well arrangement. Taking into account the increased spacing in the three-well test, the power distribution may have been increased by a factor of three or four or more. This can reasonably explain why in actual field testing, as hereinabove described, the three-well, three-phase AC installation obtained increased formation pressures over a larger reservoir area with about a third of the power required in the two-well single-phase AC test.

Accordingly, greater effects may result from multiple electrode well patterns that treat as large a zone of the formation as possible and practical. increased spacing of the electrodes may enhance results; however, more power will probably be required to treat the formation volume as the separation of the electrodes increases. FIG. 9 illustrates a fourwell pattern in a triangular configuration with one electrode well in the center. Electrode wells 123, 124 and 125 define the triangular pattern and well 126 is positioned equidistant from each of the three wells. AC power is supplied by a source 127 and is applied to wells 123, 124 and 125 by conductors 129. A return path is provided by electrode well 126 and conductor 128. In this configuration, three well-pairs can be established with a voltage drop between well-pairs as shown by $E_1$, $E_2$ and $E_3$. FIG. 10 illustrates a five-well pattern in a square or diamond configuration with one electrode well in the center. The electrode wells 190, 191, 192 and 193 define the square or diamond pattern with well 194 acting as the center well. A source of electrical power 195 is connected to electrode wells 190-193 by conductors 197 and to the center electrode well 194 by means of conductor 196. In this configuration, four well-pairs are established with a voltage drop between well pairs as shown by $E_4$, $E_5$, $E_6$ and $E_7$. Obviously, other patterns having a plurality of electrode pairs can be utilized to treat a subsurface earth formation. The number, pattern and spacing of the electrode wells will determine the pattern area, size and intensity of the electrical field established and of the electrochemical field established.

Referring now to FIG. 11, another embodiment of an electrode well apparatus is diagrammatically shown. The apparatus may be utilized in a two-well installation, as shown in FIGS. 2 and 3, or a three-well installation, as shown in FIGS. 5 and 6. A borehole 50 is shown penetrating earth formation 60 and oil-bearing formation 61. The borehole is lined through the earth 60 with a non-conductive or electrically insulating casing 58, such as fiberglass, and is lined in the oil-producing formation 61 by means of steel casing section 62, joined to the insulating casing 58 by means of a collar 64. The electrically conducting casing section 62 is conventionally perforated into the oil-bearing formation 61 by means of perforations 63. A first tubing string 66 is suspended within the insulating casing 58 and extends into the steel casing section 62, terminating just above the lower end of steel casing 62. Tubing string 66 is centralized within the borehole 50 by means of a packer 65 which is set just below the joint 78 of the insulated casing 58 and steel casing section 62, for purposes which will be hereinafter further described. A second tubing string 77 is also suspended within casing 58, spaced from tubing string 66, and terminates just above packer 65.

Casing 58 is sealed by means of a flanged cap or head 59 through which the tubing strings 66 and 77 project. Tubing string 66 acts as the electrode for the electrode well and is energized by means of electrical power from a source such as source 53 (see FIG. 8) through conductor 55, or from source 32 as shown in FIG. 3.

As previously discussed, the heating action of the electrical current passing through the salt water in the oilbearing formation causes an increase of temperature within the well bore. The temperatures in the immediate vicinity of the electrode, and particularly within steel casing section 62 and in the salt water surrounding tubing string 66, acting as the electrode, can become quite high, on the order of 200° F. or higher. If the salt water within steel casing section 62 backed up into the insulating casing 58, the high temperatures might result in damage to the insulating casing, such as fiberglass, and damage to the borehole. Thus, packer 65 is set just below the joint 78 between the insulating casing 58 and the steel casing 62 to insure that salt water will not rise above packer 65 and contact the lower portion of insulating casing 58.

Under the pressures encountered in the well bore and the temperatures produced by the process, the salt water within the well bore and in the immediate surrounding area of the oil-producing formation 61 may be reduced to steam, which is not an electrical conductor. Accordingly, to enhance the electrical contact between formation 61 and electrode 66, it may be necessary to add salt water (or other suitable electrolyte) from time to time to the borehole 50 from a salt water source 67, via piping 58 and 70 and pump 69, if necessary, through the tubing string 66 to the interior of casing section 62. Thus, salt water can be introduced into the interior of steel casing 62 and into the formation 61 to maintain electrical contact with the connate salt water in formation 61. In addition, the depletion of salt water surrounding electrode 66 encourages electrical arcing which can damage both the steel casing 62 and the electrode 66.

While the field tests of the process, both single-phase A and three-phase AC, have never produced steam, or temperatures that could produce steam, and there has not been any erosion damage to the electrodes that could result from arcing, it is considered to be advisable, as a safety precaution, to provide means for maintaining a supply of saline water from the surface to insure against arcing between the electrode and the formation as above described.

Even as hereinbefore described with packer 65 set to prevent heated salt water from rising into and damaging the lower portion of insulating casing 58, the joint 78 may still become extremely hot because of heat conduction through casing 62 and collar 64; and to further alleviate the risk of damage to casing 58, a system for cooling the joint 78 may be utilized which includes filling the annular space within casing 58 with a siitable cooling fluid 71, such as diesel oil or other thin petroleum based liquids, or even water, and circulating the fluid through tubing 77 by means of a pump 75, and piping sections 72, 74 and 76 and a cooler 73. The circulating flow of fluid through tubing string 77 over the heated joint 78 and casing 58 will cool the lower portion of fiberglass casing 58 and maintain the temperature of the casing at an acceptable level.

Referring now to FIG. 12, another embodiment of the apparatus that may be utilized as an electrode well for use in two-well installations such as those shown in FIGS. 2 and 3, or in three-well installations as shown in FIGS. 5 and 8, is diagrammatically illustrated. A borehole 80 is shown penetrating an earth formation 85 into an oil-producing formation 86. The borehole 80 is lined with a non-conductive or insulating casing 81, preferably fiberglass casing, through the earth formation 85 and is lined in the oil-producing formation 86 by means of a steel casing section 83. Steel casing section 83 is conventionally completed utilizing perforations 89 into the oil-producing formation 86. A string of tubing 87 of smaller diameter than casing 81 is concentrically suspended within casing 81 to a point approximating the joinder of the earth formation 85 and the oil-producing formation 86. Tubing 87 may either be conventional steel tubing or may be an insulated or nonconductive tubing. A string of suitable tubing 88 is concentrically suspended within tubing 87 and projects into the interior of steel casing section 83 to act as an electrode and to provide means of adding salt water to the formation, if necessary, as previously described with regard to the apparatus shown in FIG. 11. Casing 81 is closed with a cap 82, and tubing 87 is appropriately sealed to tubing 88. Packers 91 and 92 are disposed between casing sections 83, the end of tubing 87, and tubing 88 for centraizing and sealing the casing section 83 from the chambers created by insulated casing 81 and the tubing 87, as will be hereinafter further described.

Tubing 88 becomes an electrode when connected by means of conductor 93 to an appropriate source of electrical power, such as source 53, as shown in FIG. 5, or the source of electrical power 32, as shown in FIGS. 2 and 3. A salt water tank 94 is connected to a pump 96 by means of piping 95, the pump in turn being connected to tubing string 88 by means of piping 87 for providing a means for pumping salt water into the interior of steel casing section 83 and thence into the formation 86 for the reasons hereinabove described with regard to the apparatus shown in FIG. 11.

As hereinabove described, the electrodes and other aboveground equipment are insulated from earth 85. Tubing 87 has performations 90 completed just above the area where packers 91 and 92 have been set for providing communication with the interior of tubing 87 and the interior of casing 81. Cooling fluid 100 is introduced into the interior annular space of tubing 87, and can then be circulated through tubing 87, through perforations 90, and into the annular space of casing 81 to cause the fluid to flow over the joint between insulating casing 81 and steel casing section 83 to cool the lower portion of casing 81 for the purposes hereinabove described with regard to the apparatus shown in FIG. 11. Fluid from the interior of casing 81 will be circulated through piping 101 to a cooler 102, and then piped via piping 103 to pump 104, where the fluid is transported through piping 105 to the interior annular space 98 of tubing 87. The cool fluid travels down the annular space 98 within tubing 87, out through perforations 90, over the lower portion of the insulated casing 81, and returns through the annular space 99 of casing 81 to return to the cooling means 102 via piping 101. In this way, cooling of the lower section of the insulating casing 81 may be effected for the purposes hereinabove described.

Referring to FIG. 13, yet another apparatus emdodiment for equipping a well bore is shown. The apparatus of FIG. 13 could be utilized in a two-well installation shown in FIGS. 2 and 3, or in a three-well installation shown in FIGS. 5 and 8. A borehole 159 is shown penetrating the earth 164 into an earth formation or oil-bearing formation 165. The borehole 159 is lined with conventional steel casing 160 from the surface to a lower point in the earth 164, and then lined with an elecrically non-conducting or insulating casing section 161. The borehole in formation 165 is lined with an electrically conducting casing 162. Collars 163 couple casing sections 160, 161 and 162 together. A fiberglass or other electrically insulating tubing 167 is suspended in borehole 159 and centralized and supported by packer 166. Packer 166 also seals the annular space between tubing 167 and casing section 161 for purposes to be hereinafter further explained. Casing 162 has a plurality of perforations 169 disposed therein into the formation 165.

An electrode 168 of suitable material is disposed concentrically within tubing string 167 down into formation 165. An insulated head 170 seals casing 160 around tubing 167, and a suitable head seals tubing 167 around electrode 168. Electrical power from a suitable source is applied to electrode 168 via conductor 171. Piping conduit 172 is connected with the interior of tubing 167 for introducing salt water into the borehole, if necessary, as hereinabove described in connection with the previous embodiments.

In this embodiment, the borehole is not fully insulated with electrically insulating casing. The purpose of the fully insulated casing of previous embodiments is to insulate the electrode from the earth structure for preventing a direct current path between the electrode and the earth structure overlying the oil-bearing formation. In addition, the insulation of the borehole prevents a return current path from the electrode disposed in the earth formation back through the borehole to said overlying earth structure. In the embodiment of FIG. 13, a direct current path from the earth structure 164 is prevented by insulating tubing 167 and can be enhanced by filling the annulus surrounding tubing 167 with an insulating fluid such as oil 176. If insulating casing section 161 is of sufficient length, a return current path from the electrode 168 in formation 165 will be effectively broken, thereby effectively insulating electrode 168 from a return current path through borehole 159 into earth structure 164. This isolates the electrical current in formation 165 as previously described.

During operation of the electrode well, formation fluids may tend to back up into tubing 167, exerting substantial pressures on the interior of the tubing, and the addition of oil 176 in the casing annulus can also help equalize this pressure on the insulating tubing. Control of the AC current flow through electrode 168 and formation 165 for controlling pressure and temperature can be achieved as hereinbefore described by appropriate regulation and/or timing equipment.

In FIG. 14 a simple embodiment of apparatus for equipping an electrode well is shown. Borehole 200 is shown penetrating earth strata 206 and oil-bearing earth formation 207. An insulated cable 202 having an electrical insulating jacket or cover 203 and a conductor 204 is disposed in the borehole. Insulating jacket 203 is stripped from the end of the conductor 204 to expose the conductor throughout the earth formation for acting as an electrode. Gravel or other suitable porous material is packed around exposed conductor 204 in the borehole portion extending into the formation 207 to permit the electrode to have communication with formation fluids. The borehole above formation 207 can then be filled with insulating cement 201 to give structural support to cable 202 and to support the borehole without having to set casing. The upper surface end of the cable 202 is connected to a suitable source of AC electrical power by means of conductor 208. Formation fluids, such as salt water and oil, will flow through the porous gravel 205 and make contact with electrode 204 for establishing the electrical field in the formation 207, as hereinabove described.

Referring now to FIGS. 5, 8 and 15, a three-electrode well installation, as shown in FIG. 5, could be effectively patterned as shown in FIG. 15 to progressively cover an increasingly larger area and thereby both heat an increased area of the oil-bearing formation, stimulate gas production in the formation over a much wider area, and lower the viscosity of the oil to enhance its flow characteristics. In FIG. 15, three electrode wells 110 could be drilled and completed in a triangular pattern shown as pattern 111. This installation could be utilized for a predetermined period of time, and then by drilling another electrode well 110, a second triangular pattern 112 could be accomplished and operated for a second predetermined period of time. It is possible to exhaust some of the formation fluids in the area defined by the electrode well bores due to the decomposition of the electrolyte in the formation and recovery of the oil in the area treated. However, tests demonstrate that relocation of the electrode pattern provides new formation fluids and also moves new fluids to old areas. By drilling additional electrode wells 110, a series of triangular patterns 113-122 could be accomplished, thus distributing the electrical current over a broad reservoir area. The gas production in the oil-bearing formation would be enhanced, and the small thermal action of the AC electrical current would be distributed over a much wider area in the reservoir oil-bearing formation. Of course, any electrode wells 100 not being utilized as electrode wells in a particular installation pattern may be rigged as producing wells. In actual field tests the spacing of the three electrode wells was 200 feet, but it is believed that much larger distances may be utilized to enlarge an installation pattern and electrochemically generate gases in-situ to pressure the formation, and the electrochmical action on the chemical composition of the oil to enhance its flow characteristics. The use of the patterns shown in 113-122 produces twelve injection patterns using thirteen wells, and when completed can be used for six patterns, each four times as large as any original pattern, such as a pattern comprising smaller patterns 111, 112, 113 and 118. It can also be seen from the above description of FIG. 15, that the "add-a-well" concept also decreases the cost or investment in a new pattern.

As hereinbefore described, laboratory tests have revealed that AC current will cause the oil film surrounding "waterwetted" sand to be released from the sand grains of a simulated formation matrix and that separation of the oil and water is caused by gravitational forces that will tend to force the oil to rise in the matrix while water tends to be displaced to a lower level in the matrix. It is believed that under certain geological conditions this same result can be achieved in an actual reservoir formation. Accordingly, the pattern development disclosed in FIG. 15 could be especially useful to release residual oil remaining within the reservoir pore space and allowing it to move by gravitational force to the upper reaches of the oil-bearing formation for enhancing production from the strata. This is particularly true of the suggested patterns shown in FIG. 15, where broad areas of the formation could be treated simultaneously and successive patterns swept across a predetermined area to treat the formation, generate gas in situ and release the residual oil in the formation pore space matrix.

In discussing the three-well, three-phase AC installations, as shown particularly in FIGS. 5 and 8, a simplified circuit schematic of the system can be represented as shown in FIG. 17. With a three-phase AC source 53 (see FIG. 5) connected between electrodes 50 and 51 by conductors 55 and 56, current $I_e$ will flow through conductor 55, tubing electrode 50, represented by resistor $R_{e50}$, through one leg of an assumed "delta" load comprising the conductive substances of the formation, primarily salt water, represented by resistor $R_{w1}$, and then through conductor 56. Assuming a balanced three-phase power source and a balanced "load" (the earth formation) then:

$$V_1 = I_e R_{e50} + I_e R_{e51} + I_w R_{w1} \tag{18}$$

but, since $I_e = \sqrt{3} I_w$ then $$V_1 = \sqrt{3}\ I_w R_{e50} + \sqrt{3}\ I_w R_{e51} + I_w R_{w1} \tag{19}$$

$$V_1 = I_w(\sqrt{3}\ R_{e50} + \sqrt{3}\ R_{e51} + R_{w1})$$

$$I = \frac{V_1}{\sqrt{3}\ (R_{e50} + R_{e51}) + R_{w1}}$$

However, in actual practice the "delta" load representing the formation will not be balanced due to geological variations, and $I_w$ in the various legs of the "delta" system load then would not be balanced and the current, $I_w$, through $R_{w1}$, $R_{w2}$ and $R_{w3}$ would be unequal. While this is true, loads can be balanced in the generator by creating more resistance in the surface cables, or by changing the shape of the pattern to fit resistance requirements.

Referring now to FIG. 18, yet another embodiment of the apparatus is illustrated. In FIG. 18, an electrode borehole 130 is drilled through earth formation 133 and oilbearing formation 134 and is shown having an electrically insulating casing 135 and a steel casing section 137 set in the oil-bearing formation 134, the two casings being joined by a collar 138. A tubing string 136 is inserted within well bore 130 and extends into the steel casing section 137. Tubing string 136 is centralized by means of a packer 139 that seals the space within the interior of steel casing section 137 and the interior of insulating casing 135, as hereinabove described for previous embodiments shown in FIGS. 3, 11 and 12. Of course, the borehole 130 may be constructed alternatively as disclosed in previous embodiments. Two additional boreholes 131 and 132 (not shown in detail) are completed to form a triangular, three-electrode well installation, as shown in FIG. 5, for instance. Of course, other multiple well patterns could be utilized. Three-phase AC power would be provided by a generator 140 and applied to electrodes 136, 144 and 158 of boreholes 130, 131 and 132, respectively, by conductors 141, 142 and 143, respectively. Three-phase AC power could be applied to the oil-bearing formation 134 to produce heat and gas insitu, as hereinabove described, to promote oil recovery.

As hereinabove described, boreholes 130, 131 and 132 are insulated, as well as all above ground equipment, from earth 133 to isolate the AC electrical current in formation 134.

A plurality of producing boreholes 145, only one of which is diagrammatically shown penetrating earth formation 133 and the oil-bearing formation 134, would be conventionally completed to produce oil from formation 134. The oil may be produced through a tubing string 146 by various conventional means and supplied via piping 147 to a pump 148 for transfer to an oil storage tank 149. This would be conventional production and storage to this point, assisted by use of the invention to enhance oil recovery. But in a large reservoir, which would contain substantial oil reserves sufficient to support an industrial plant having a need for large volumes of fuel oil as an energy source, the exhaust or "flue" gases from such a plant could be utilized in further enhancing the production capabilities of the reservoir. Assuming the industrial plant to be an electrical generating plant utilizing oil-fired turbines, the plant could be constructed immediately adjacent the reservoir area for receiving the produced oil and for minimizing the distance that the flue gases must be transported prior to use in the reservoir. This embodiment is described in relation to an electrical generating plant, but other industrial plants having a high fuel oil energy need and creating substantial quantities of useful exhaust gases could, of course, be substituted.

Referring again to FIG. 18, the produced oil would be transferred from the oil storage tanks 149 to the electric generating plant 151 by means of pumps 150 for supplying the crude oil to appropriate treating means, if necessary (not shown), to prepare the crude oil for firing the turbine generators. The oil-fired turbines would generate electrical power for distribution by the generating plant in the power company's power distribution system. The output flue gases of the oil-fired turbines would be collected at 152 and routed through piping 153, pump 154 and piping 155 to a pipe or tubing 157 disposed in injection borehole 156, as shown penetrating the earth formation 133 and the oil-producing formation 134. In actual operation, the injection borehole 156 would be located in or adjacent the pattern of the three electrode wells 130, 131 and 132, although not so shown in the diagrammatic illustration of FIG. 18. The hot pressurized flue gas introduced into the oil-bearing formation 134 through injection well 156 will lower the viscosity of the oil and enhance its flow characteristics. The flue gas or combustion gases from an oil-fired turbine or engine will contain large percentages of carbon monoxide and carbon dioxide as well as other gases. The carbon dioxide and carbon monoxide gases, whether heated or not, will tend to combine with the oil in the producing formation, as hereinabove described, and in so doing combine chemically with the oil to lower its viscosity and specific gravity and improve its flow characteristics. In addition, the flue gas will ordinarily be hot (in the range of 800°–1,000° F.) and will act to dissolve tars and further lower the viscosity of the oil. In addition, the flue gas could be pumped back into the formation under pressure adding to the formation pressure and further enhancing the formation driving energy.

The combustion gases will have a considerable BTU content since not all of the hydrocarbons have been burned, and the long term injection of the gas into the formation will create a reservoir of gas having considerable BTU value that could create a source of gas for future recovery and use as a fuel.

The use of the flue gas injection process would be ideally suited for use in an area where there is a large reservoir of very viscous oil or sands having asphaltic tars of extremely low gravity and high viscosity that can be produced by use of the invention herein described and recovered in quantities sufficient to operate an industrial plant that, in turn, would generate sufficient quantities of combustion or flue gases that could be returned to the formation for the purposes hereinabove mentioned. As an example, a one-megawatt electrical generating plant could utilize 40,000 barrels of oil a day produced from the oil reservoir and generate 200,000,000 cubic feet of combustion gases a day for reinjection into the oil-bearing formation. This system could have particular economic appeal to many industries dependent upon oil or natural gas as a fuel, since natural gas is in short supply and heavy residual oil may economically be recovered by use of the electrical process herein described.

In addition, there are environmental benefits accruing from the utilization of the installation and process shown in FIG. 18, since the flue gases would be returned into the ground for use in enhancing recovery of oil and not released into the atmosphere as a pollutant. It should be noted that this return of the flue gases could be combined with the injection of the $CO_2$ gases produced during the application of the AC power to the oil reservoir and subsequently collected at the surface, as hereinabove described.

Referring now to FIGS. 18 and 19, FIG. 19 discloses another embodiment of the flue gas injection process. Electrode wells 130, 131 and 132 penetrate earth formations 133 and are completed in oil bearing formation 134B in the same manner hereinabove described in FIG. 18. The strata or formation 134A is a permeable zone or strata overlying the oil formation 134B and may have at one time contained natural gas that provided a "gas cap" or drive for the oil in formation 134B and the drive may now be partially or completely depleted. Similarly, producing well 145 is completed in formation 134B for recovery oil which is pumped to storage tank 149 for use as a fuel to fire turbines in plant 151 as described for the embodiment disclosed in FIG. 18.

The flue gases from plant 151 are collected at 152 and are pumped into injection wells 154 and 162 by means of pump 154 and piping 155 and 160. Injection well 156 is not shown in detail, but could be completed in formation 134B as disclosed in FIG. 18. However, injection well 162 could be similar or identical to well 156 but would be completed in the gas permeable zone 134A. The flue gases introduced into formation 134B would enhance the flow characteristics of the oil in formation 134B, as hereinabove described, while the flue gases introduced into formation 134A would permeate strata 134A to assist in establishing a "gas cap" or gas pressure zone to assist in providing gas drive pressure for formation 134B, in addition to the gas pressures resulting from the operation of wells 130, 131 and 132.

In addition, compressed air can be pumped into permeable zone 134A by means of compressor 165 and piping 166 and 167 penetrating earth formation 133 in air injection borehole 168. Similar to injection well 162, well 168 is completed in permeable zone 134A to distribute the compressed air into strata 134A to enhance the driving pressure applied to formation 134B. With conventional air injection equipment, it would be easy to obtain formation 134A pressures of 300 to 500 psi, or greater, depending on the depth of the strata and the pressure that the overlying earth formation 133 could withstand without ruptureing. In addition, air when mixed with the heated combustion gases will cause "combustion" of the air and produce additional volumes of carbon dioxide and carbon monoxide for treating the formation. Two other advantages of the "flue gas" injection process described in connection with FIG. 18 are also applicable to the system shown in FIG. 19.

In all of the foregoing embodiments herein described, it must be emphasized that the electrochemical effects and phenomical effects and phenomena occurring, based principally on the effects of AC disassociation of electrolyte water, are long-term residual effects and are not temporary in nature. While heat can decrease the apparent specific gravity and viscosity of oil, if the heat is eliminated or does not persist, the oil at ambient temperatures will retain its original viscosity and specific gravity. However, the electrochemical effects herein described permanently alter the chemical and physical properties of the treated oil, and, accordingly, the lowering of the viscosity and specific gravity, as hereinabove described in detail, are long term residual effects and benefits, even if the process is discontinued.

While the foregoing specification principally describes the invention in terms of tertiary recovery of oil, the invention admits to a much broader scope of application. It is contemplated that the basic in-situ gas generation processes and the electrochemical effects on hydrocarbon constituents of fossilized mineral fuels could be useful in the following applications:

1. Recovery of bitumens from asphaltic tars;
2. Recovery of kerogens from oil shales;
3. In-situ gasification of bituminous coal deposits; and
4. In-situ recovery of coal in a fluidized form from a subsurface formation.

or example, in a subsurface coal formation or deposit, electrode injection wells could be completed similar to electrode wells 30 or 50, 51 and 52 of FIGS. 3 and 8. The coal formation could be fractured using conventional techniques and a suitable solvent injected into the formation through the electrode wells as shown in FIG. 11, or special solvent injection wells could be used. In addition, a surfactant-electrolyte such as a suitable detergent or detergent-acting polymer would be injected into the formation as disclosed in FIG. 11 or by special injection wells. The surfactant-electrolyte acts to "wet" the exposed coal formation surfaces and interact with the solvent and coal to make the solvent and dissolved coal product miscible in the electrolyte. The electrolyte, due to AC disassociation as hereinabove described, would liberate gases, such as hydrogen and oxygen, to interact with the solvent-dissolved coal fluid to further generate gases for pressurizing the coal formation and aiding in the recovery of the solvent-dissolved coal fluid. The solvent could thereupon be separated from the fluidized hydrocarbon residue of the coal for reinjection into the formation. Similarly, such a gas generation and treatment process could be applied to other fossilized mineral fuel deposits to enhance and aid in the recovery of the hydrocarbon fuel products.

While in each of the above applications, "water-wetted" sands or other naturally occurring electrolytes may not be present or not present in sufficient quantities to serve as an effective electrolyte, as hereinabove described, other fracturing, flooding and electrolyte injection techniques may be utilized in combination with the disclosed invention to produce the desired recovery of hydrocarbon products as above described.

As hereinabove discussed, it is postulated that the Ac electrical field produced by the method and apparatus according to the present invention results in the release of dissolved methane from a water solution. It is possible that this phenomenon can be used to tap an enormous supply of methane, heretofore commercially unavailable, according to an embodiment of the present invention, hereinbelow discussed.

It has been estimated that up to 50,000 trillion cubic feet of methane is dissolved in areas of the Gulf of Mexico at depths of about 15,000 feet. This methane laden water could be pumped to the surface, or some intermediate level, where the great decrease in pressure would result in some methane coming out of solution. Such an attempt to move great volumes of water would, in itself, consume large quantities of energy. It would be highly desirable to liberate the methane and allow the released molecules to coalesce and rise toward the surface.

Referring now to FIG. 20, there is seen methane collection barge 210 covering a large ocean 212 surface area over which released methane is to be trapped upon emerging from the water. The methane collection barge 210 is held generally in position by conventional positioning and mooring apparatus, which may range from sea anchors in a simple case to self-propelled barges having steerable propellors or water jets to actively position collection barge 210. Emerging methane is collected beneath collection tent 222, where numerous transfer tubes 224 open to the methane and interconnect with large tankers 226 where the gas is compressed and liquified for transportation to shore. An AC generator barge 216 provides the power source to induce the required electric field. Insulated power cables 218 are supported by at least one float 220 within the collection tent 222. It is clearly within the scope of the present invention to provide intermediate floats for any single grouping of AC power cables or to support multiple groupings of AC power cables if it is desired to inject AC current at more than one location beneath collection tent 222.

A cross-section view of FIG. 20 along lines 21—21 is shown in FIG. 21. Positioning and mooring apparatus 214 are maintaining methane collection barge 210 generally over a selected area. Generator barge 216 is providing AC three-phase power to insulated cables 218 beneath collection tent 222. Collection tent 222 is supported by floats 230 which may be any conventional bouyant structure placed about the periphery of collection tent 222 and/or beneath the tent surface. A skirt 232 is provided to prevent the escape of methane or the admission of air due to openings beneath bouyant members 230 as collection barge 210 responds to wave action. Floating cable support 220 is sized to support the cables 218 and electrodes 228 suspended beneath the float. If needed, spacers (not shown) can be provided to maintain physical separation of suspended cables 218. Insulated cables 218 terminate in electrodes 228.

As hereinabove discussed, an AC current can produce disassociation of water molecules under certain conditions, and particularly when certain critical current densities are obtained. The AC electric field also disassociates methane molecules which have become electrically associated with water molecules. Accordingly, the electrodes 228 are placed at a selected depth where large quantities of dissolved methane have been determined to exist. In this instance, the electrical power requirements are calculated to produce critical current densities at the electrode 228 surfaces and, preferably, at some locations between adjacent electrodes. The basic considerations discussed above for producing gas in a geological formation are thought to be appropriate for a submerged location. It may be necessary to provide electrodes at intermediate depths to keep the evolved gases out of solution.

As methane, hydrogen, and oxygen molecules are produced by the AC electrical field, it is felt that the evolved molecules will have upward mobility and will begin to coalesce as large quantities are produced. Secondary effects from the operation may also act to increase gas production. First, heat is generated during the disassociation of methane from the water. If a sufficient thermal driving head is produced, the resulting convection could move other methane-laden water up to lower depths where more methane will come out of solution at the lower pressure. Second, upward movement of the coalesced gases might act to "strip" additional methane molecules from the water.

Referring now to FIG. 22, there may be seen collection tent 222 ballooned upward by collected gases emerging from beneath ocean 212. Collection tent 222 is floated on bouyant members 230, which may be conveniently placed about the periphery of tent 222. Skirt 232 depends downwardly from bouyant member 230 beneath the surface of ocean 212. A weight member 234 might be used to hold skirt 232 in place beneath collection barge 210. Transfer tubes 224 are open to the volume beneath collection tent 222 for receiving evolved gases. Air chambers 236 may be provided to rigidify tube 224 between methane collection barge 210 and storage ship 226. Transfer tube 224 is connected with ship 226 by conventional apparatus engineered to conform to maritime regulations and a variety of connector designs may be employed as needed. The transferred methane goes to compressor station 238 for liquification and storage. When ship 226 is filled, it returns to port to discharge the methane and thereafter returns to collection barge 210 for another load.

Numerous variations and modifications may obviously be made in the structure and processes herein described without departing from the present invention. Accordingly, it should be clearly understood that the forms of the invention herein described and shown in the figures of the accompanying drawings are illustrative only and are not intended to limit the scope of the invention.

What is claimed is:

1. A method of recovering geopressured methane dissolved in ocean salt water at a predetermined depth, comprising the steps of disposing at least two spaced-apart electrodes into electrical contact with the ocean salt water carrying the dissolved methane gas at the predetermined depth, said ocean salt water acting as an electrolyte in contact with said electrodes, insulating said electrodes from substantially all overlying ocean salt water above a selected depth leaving a selected length of each electrode exposed in electrical contact with the ocean salt water carrying the dissolved methane gas to establish an electrical circuit composed of said electrodes and said salt water electrolyte at said depth containing said geopressured methane, establishing an AC electrical current flow in said electrodes and said salt water electrolyte at said geopressured methane depth for establishing an AC electrical field surrounding said electrodes for establishing a current density in the ocean salt water carrying the dissolved methane gas in an area surrounding said electrodes exceeding the minimum current density required to cause AC disassociation of saltwater, electrochemically releasing as a free gas said dissolved methane gas and other free gases from said ocean salt water in said area surrounding said electrodes as a function of said current density in said area exceeding said minimum current density and causing AC disassociation of the salt water for allowing said free methane gas to rise to the surface of the ocean, and recovering said free methane gas at the ocean surface.

2. The method as described in claim 1, wherein said free gases include hydrogen and oxygen.

3. The method as described in claim 1, wherein said current flow between said electrodes is a flow of single-phase AC current.

4. The method as described in claim 1, wherein said number of electrodes is three and said current flow between said electrodes is a flow of three-phase AC current.

5. Apparatus for recovering geopressured methane dissolved in ocean salt water at a predetermined depth, comprising at least two spaced-apart electrodes in electrical contact with the ocean salt water carrying the dissolved methane gas at the predetermined depth, said ocean salt water acting as an electrolyte in contact with said electrodes, said electrodes being insulated from substantially all overlying ocean salt water above a selected depth leaving a selected length of each electrode exposed in electrical contact with the ocean salt water carrying the dissolved methane gas to establish an electrical circuit composed of said electrodes and said salt water electrolyte at said depth containing said geopressured methane;

means for establishing an AC electrical current flow in said electrodes and said salt water electrolyte at said geopressured methane depth for establishing an AC electrical field surrounding said electrodes for establishing a current density in the ocean salt water carrying the dissolved methane gas in an area surrounding said electrodes exceeding the minimum current density required to cause AC disassociation of saltwater and electrochemically releasing as a free gas said dissolved methane gas and other free gases from said ocean salt water in said area surrounding said electrodes as a function of said current density in said area exceeding said minimum current density and causing AC disassociation of the salt water for allowing said free methane gas to rise to the surface of the ocean, and means for recovering said free methane gas at the ocean surface.

6. Apparatus as described in claim 5, wherein said means for establishing an electrical current flow further includes a plurality of insulated cables for conducting an AC electrical current flow to said electrical circuit composed of said electrodes and said salt water electrolyte at said geopressured methane depth, generator means for establishin a current density in said geopressured methane ocean area surrounding said electrodes exceeding the minimum current density required to cause AC disassociation of salt water and electrochemically generate free gases in said geopressured methane ocean zone between said electrodes as a function of current density in said zone exceeding said minimum current density.

7. Apparatus as described in claim 6, wherein said number of electrodes is two and said current flow between said electrodes is a flow of single-phase AC current.

8. Apparatus as described in claim 7, wherein said number of electrodes is three and said current flow between said electrodes is a flow of three-phase AC current.

9. Apparatus as described in claim 7, wherein said means for recovering said free methane gas includes a large area flexible sheet disposed on the ocean surface above said electrodes and forming a tent-like structure for trapping said free methane gas as said methane gas rises to the surface of the ocean, means for floating said flexible sheet on the surface of said ocean, and means for transferring said methane gas from beneath said flexible sheet to a storage facility.

* * * * *